US011927063B2

(12) United States Patent
Martin

(10) Patent No.: US 11,927,063 B2
(45) Date of Patent: Mar. 12, 2024

(54) KICKOVER TOOL

(71) Applicant: Impact Selector International, LLC, Heath, TX (US)

(72) Inventor: Brandon Martin, Forney, TX (US)

(73) Assignee: IMPACT SELECTOR INTERNATIONAL, LLC, Heath, TX (US)

( * ) Notice: Subject to any disclaimer, the term of this patent is extended or adjusted under 35 U.S.C. 154(b) by 0 days.

(21) Appl. No.: 17/938,899

(22) Filed: Oct. 7, 2022

(65) Prior Publication Data

US 2023/0114031 A1 Apr. 13, 2023

Related U.S. Application Data

(60) Provisional application No. 63/262,335, filed on Oct. 8, 2021.

(51) Int. Cl.
*E21B 23/03* (2006.01)
*E21B 43/12* (2006.01)

(52) U.S. Cl.
CPC ..... *E21B 23/03* (2013.01); *E21B 43/123* (2013.01)

(58) Field of Classification Search
CPC ..... E21B 23/03; E21B 43/123
See application file for complete search history.

(56) References Cited

U.S. PATENT DOCUMENTS 3,727,683 A * 4/1973 Terral ..... E21B 23/03 166/117.5
3,732,928 A 5/1973 Sizer
3,837,398 A * 9/1974 Yonker ..... E21B 23/03 166/117.5
3,891,032 A 6/1975 Tausch et al.
4,146,091 A * 3/1979 Terral ..... E21B 23/03 166/117.5
2020/0340317 A1 10/2020 Romer et al.

FOREIGN PATENT DOCUMENTS

EP 2540955 A1 1/2013
WO 2023/060223 A2 4/2023

OTHER PUBLICATIONS

PCT/US2022/077742 International Search Report and Written Opinion dated Apr. 28, 2023, 19 pages.

* cited by examiner

*Primary Examiner* — D. Andrews
(74) *Attorney, Agent, or Firm* — Boisbrun Hofman, PLLC

(57) ABSTRACT

A kickover tool for retrieving a used gas lift valve installed within a gas lift mandrel connected along a wellbore tubular string and installing a new gas lift valve within the gas lift mandrel. The kickover tool may include a housing, a first holder configured to hold the used gas lift valve, a first displacement mechanism operable to move the first holder between a retracted first holder position in which the first holder is adjacent the housing and an extended first holder position in which the first holder is spaced away from the housing, a second holder configured to hold the new gas lift valve, and a second displacement mechanism operable to move the second holder between a retracted second holder position in which the second holder is adjacent the housing and an extended second holder position in which the second holder is spaced away from the housing.

15 Claims, 11 Drawing Sheets

KICKOVER TOOL

CROSS-REFERENCE TO RELATED APPLICATIONS

This application claims priority to and the benefit of U.S. Provisional Application No. 63/262,335, titled "Kickover Tool," filed Oct. 8, 2021, the entire disclosure of which is hereby incorporated herein by reference.

BACKGROUND OF THE DISCLOSURE

Oil and gas wells are drilled into Earth's surface or ocean bed to recover natural deposits of formation fluid (e.g., oil, gas, etc.) trapped within reservoirs in subterranean geological formations. After a wellbore is drilled, a casing string may be inserted therein and secured via cement, such as to protect the sidewall of the wellbore, isolate different subterranean formations, and maintain control of the formation fluid and well pressure during various subsequent downhole operations. Thereafter, additional metal tubular strings may be inserted within the wellbore to facilitate delivery of a treatment fluid downhole and transfer the formation fluid to the wellsite surface. After the well is completed, various intervention operations may be performed to repair and maintain the well or otherwise optimize well productivity.

During production operations, when reservoir pressure is insufficient to force the formation fluid from the subterranean formation to the wellsite surface, gas may be injected into a production tubing string installed within the wellbore to reduce density of the hydrocarbons located within the production tubing. When density of the formation fluid is reduced, the reservoir pressure may then be sufficient to raise a column of the formation fluid within the production tubing to the wellsite surface. The gas may be conveyed downhole along an annulus between the casing and production tubing and injected into the production tubing via a plurality of gas lift valves installed at predetermined heights along the production tubing. Each gas lift valve may be installed within a side pocket of a corresponding gas lift mandrel connected along the production tubing.

A kickover tool can be used to retrieve a used gas lift valve from a side pocket of a gas lift mandrel connected along a production tubing string and install a new gas lift valve within the side pocket of the gas lift mandrel. The kickover tool comprises a gas lift valve holder configured to hold a gas lift valve and a displacement mechanism that moves the holder laterally while the kickover tool is disposed within the gas lift mandrel. During gas lift valve retrieval operations, the kickover tool is conveyed downhole from the wellsite surface along the production tubing and into a predetermined gas lift mandrel. An empty holder is then extended laterally within the gas lift mandrel and the kickover tool is lowered to connect the holder with a used gas lift valve installed within the side pocket. The kickover tool is then conveyed to the wellsite surface to retrieve the used gas lift valve to the wellsite surface. During gas lift valve installation operations, a new valve is connected to the holder and the kickover tool is again conveyed downhole from the wellsite surface along the production tubing and into the predetermined gas lift mandrel. The holder is then extended laterally and the kickover tool is lowered to install the new gas lift valve within the side pocket. The kickover tool is then again conveyed to the wellsite surface.

Current kickover tools are operable to transport just one gas lift valve at a time, thereby requiring two round trips downhole to a gas lift mandrel to replace a used gas lift valve with a new gas lift valve. Furthermore, holder displacement mechanisms of current kickover tools are susceptible to unintended operation (or triggering), such as when the kickover tool impacts a downhole object or otherwise experiences a shock while downhole. Such unintended operation requires the kickover tool to be retrieved to the wellsite surface, be reset, and then returned downhole. Also, holder displacement mechanisms of current kickover tools are complicated and, thus, more susceptible to malfunctions.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus comprising a downhole tool, wherein the downhole tool is operable to perform downhole operations to retrieve a used gas lift valve installed within a gas lift mandrel connected along a wellbore tubular string and install a new gas lift valve within the gas lift mandrel, and wherein the downhole tool comprises: a housing; a first holder configured to hold the used gas lift valve; a first displacement mechanism operable to move the first holder between a retracted first holder position in which the first holder is adjacent the housing and an extended first holder position in which the first holder is spaced away from the housing; a second holder configured to hold the new gas lift valve; and a second displacement mechanism operable to move the second holder between a retracted second holder position in which the second holder is adjacent the housing and an extended second holder position in which the second holder is spaced away from the housing.

The present disclosure also introduces an apparatus comprising a downhole tool, wherein the downhole tool is for installing a gas lift valve within a gas lift mandrel connected along a wellbore tubular string, and wherein the downhole tool comprises: a housing; a holder configured to hold the gas lift valve; and a displacement mechanism operable to move the holder between a retracted holder position in which the holder is adjacent the housing and an extended holder position in which the holder is spaced away from the housing. The displacement mechanism comprises: an arm pivotably connected to the housing, wherein the arm carries the holder; a first latch movably connected to the housing, wherein the first latch and the arm are operable to engage to prevent the arm from moving the holder from the retracted holder position to the extended holder position; a carriage assembly movably disposed within the housing (wherein the carriage assembly: is movable between a retracted carriage assembly position in which the carriage assembly is spaced away from the first latch and an extended carriage assembly position in which the carriage assembly contacts the first latch; and is biased toward the retracted carriage assembly position); and a second latch connected to the carriage assembly and operable to engage a latching feature of the gas lift mandrel.

The present disclosure also introduces an apparatus comprising a downhole tool, wherein the downhole tool is for installing a gas lift valve within a gas lift mandrel connected along a wellbore tubular string, and wherein the downhole tool comprises: a housing; a holder configured to hold the gas lift valve; and a displacement mechanism operable to move the holder between a retracted holder position in which the holder is adjacent the housing and an extended holder position in which the holder is spaced away from the housing. The displacement mechanism comprises: an arm pivotably connected to the housing, wherein the arm carries the holder; a carriage assembly movably disposed within the housing (wherein the carriage assembly: is movable between a retracted carriage assembly position in which the carriage assembly does not permit the arm to move the holder from the retracted holder position to the extended holder position and an extended carriage assembly position in which the carriage assembly permits the arm to move the holder from the retracted holder position to the extended holder position; and is biased toward the retracted carriage assembly position); a latch movably connected to the carriage assembly, wherein the latch is movable between an extended latch position in which the latch extends out from the housing such that the latch can engage a latching feature of the gas lift mandrel and a retracted latch position in which the latch does not extend out from the housing such that the latch cannot engage the latching feature of the gas lift mandrel; and a contact member connected to the housing, wherein the contact member maintains the latch in the extended latch position and is configured to move the latch from the extended latch position to the retracted latch position.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
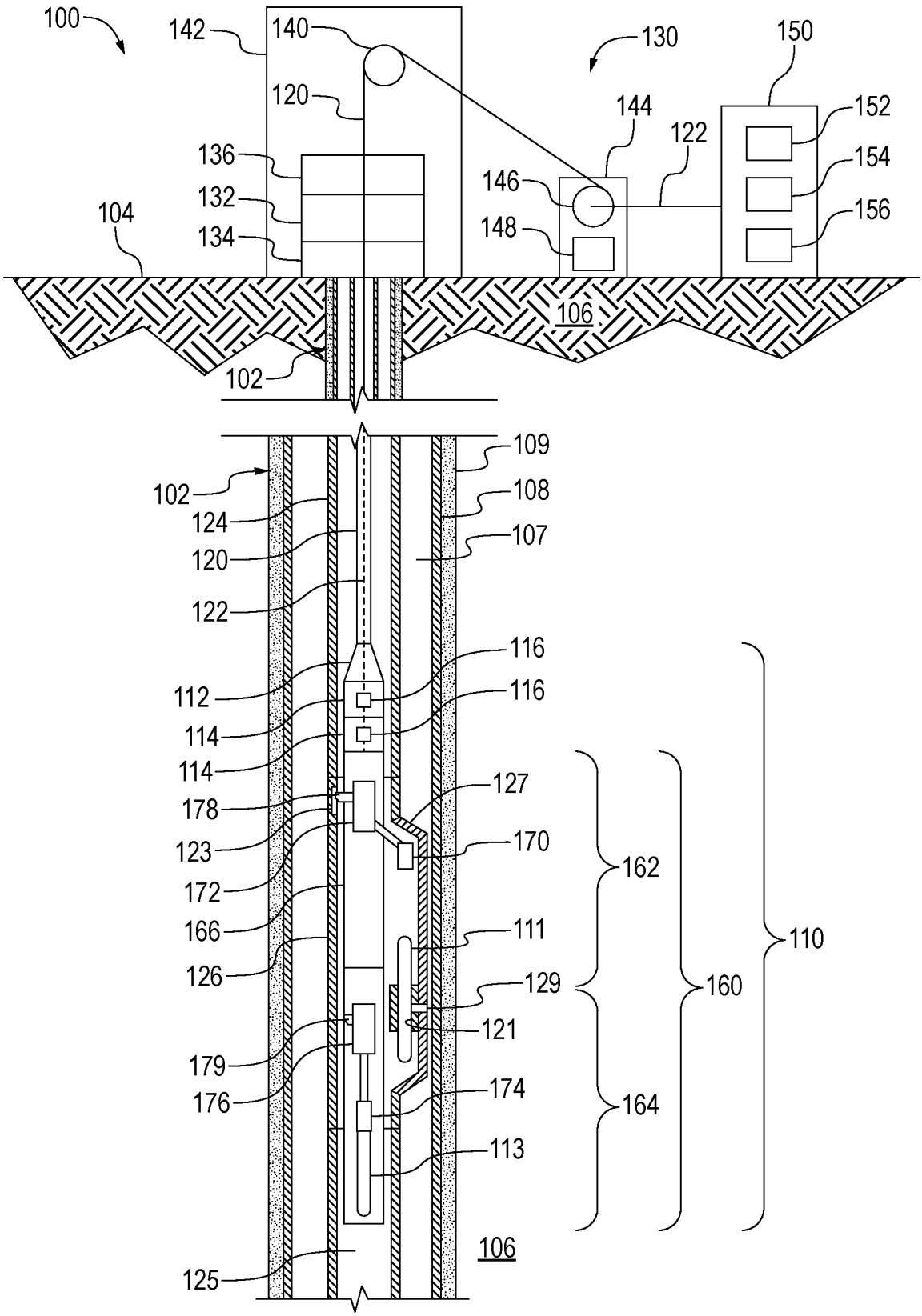
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

Furthermore, terms, such as upper, upward, above, lower, downward, and/or below are utilized herein to indicate relative positions and/or directions between apparatuses, tools, components, parts, portions, members and/or other elements described herein, as shown in the corresponding figures. Such terms do not necessarily indicate relative positions and/or directions when actually implemented. Such terms, however, may indicate relative positions and/or directions with respect to a wellbore when an apparatus according to one or more aspects of the present disclosure is utilized or otherwise disposed within the wellbore. For example, the terms upper and upward may mean in the uphole direction, and the terms lower and downward may mean in the downhole direction.

FIG. 1 is a schematic view of at least a portion of an example implementation of a wellsite system 100 representing an example environment in which one or more aspects of the present disclosure may be implemented. The wellsite system 100 is depicted in relation to a wellbore 102 formed by rotary and/or directional drilling and extending from a wellsite surface 104 into a subterranean formation 106. The wellsite system 100 may be utilized to facilitate recovery of oil, gas, and/or other materials that are trapped in the formation 106 via the wellbore 102. The wellbore 102 comprises a casing string 108 secured by cement 109. It is noted that although the wellsite system 100 is depicted as an onshore implementation, it is to be understood that the aspects described below are also generally applicable or readily adaptable to offshore implementations.

The wellsite system 100 includes surface equipment 130 located at the wellsite surface 104 and a downhole intervention and/or sensor assembly, referred to as a tool string 110, conveyed within the wellbore 102 along one or more formations 106 via a conveyance line 120 operably coupled with one or more pieces of the surface equipment 130. The conveyance line 120 may be operably connected with a conveyance device 140 operable to apply adjustable downward and/or upward forces to the tool string 110 via the conveyance line 120 to convey the tool string 110 within the wellbore 102. The conveyance line 120 may be or comprise a cable, a wireline, a slickline, a multiline, an e-line, coiled tubing, and/or other conveyance means. The conveyance device 140 may be, comprise, or form at least a portion of a sheave or pulley, a winch, a drawworks, an injector head, and/or other device operable to guide and/or move the conveyance line 120 to thereby convey the tool string 110 within the wellbore 102. The conveyance device 140 may be supported above the wellbore 102 via a mast, a derrick, a crane, and/or other support structure 142. The surface equipment 130 may further comprise a reel or drum 146 configured to store thereon a wound length of the conveyance line 120, which may be selectively wound and unwound by the conveyance device 140 to selectively convey the tool string 110 into, within, and out of the wellbore 102.

Instead of or in addition to the conveyance device 140, the surface equipment 130 may comprise a winch conveyance device 144 comprising or operably connected with the drum 146 and operable to selectively apply tension to the conveyance line 120 to convey the tool string 110 within the wellbore 102. The winch conveyance device 144 may comprise the drum 146 and a rotary actuator 148 (e.g., an electric motor) operatively connected to the drum 146. The rotary actuator 148 may rotate the drum 146 to selectively unwind and wind the conveyance line 120 to thereby apply an adjustable tensile force to the tool string 110 and, thus, selectively convey the tool string 110 into, within, and out of the wellbore 102.

The conveyance line 120 may comprise one or more metal support wires or cables configured to support the weight of the downhole tool string 110. The conveyance line 120 may also comprise one or more insulated electrical and/or optical conductors 122 operable to transmit electrical energy (i.e., electrical power) and/or electrical and/or optical signals (e.g., information, data, etc.) between the tool string 110 and one or more of the surface equipment 130, such as a power and control system 150. The conveyance line 120 may comprise and/or be operable in conjunction with means for communication between the tool string 110, the conveyance device 140, the winch conveyance device 144, and/or one or more other portions of the surface equipment 130, including the power and control system 150.

The wellbore 102 may be capped by a plurality (e.g., a stack) of fluid control devices 132, which may include fluid control valves, spools, and fittings individually and/or collectively operable to direct and/or otherwise control the flow of formation fluid out of the wellbore 102. The fluid control devices 132 may also or instead comprise a blowout preventer (BOP) stack operable to prevent the flow of the formation fluid out of the wellbore 102. The fluid control devices 132 may be mounted on a wellhead 134.

The surface equipment 140 may further comprise a sealing and alignment assembly 136 mounted on the fluid control devices 132 and operable to seal the conveyance line 120 during deployment, conveyance, intervention, and other wellsite operations. The sealing and alignment assembly 136 may comprise a lock chamber (e.g., a lubricator, an airlock, a riser, etc.) mounted on the fluid control devices 132 and a stuffing box operable to seal around the conveyance line 120, although such details are not shown in FIG. 1. The stuffing box may be operable to seal around an outer surface of the conveyance line 120, for example via annular packings applied around the surface of the conveyance line 120 and/or by injecting a fluid between the outer surfaces of the conveyance line 120 and an inner wall of the stuffing box. The tool string 110 may be deployed into or retrieved from the wellbore 102 via the conveyance device 140 and/or winch conveyance device 144 through the wellhead 134, the control devices 132, and/or the sealing and alignment assembly 136.

The power and control system 150 may be or comprise a control center utilized to monitor and control various portions of the wellsite system 100. The power and control system 150 may be located at the wellsite surface 104 or on a structure located at the wellsite surface 104. However, the power and control system 150 may instead be located remote from the wellsite surface 104. The power and control system 150 may include a source of electrical power 152, a memory device 154, and a surface controller 156. The electrical power source 152 (e.g., a battery, an electric generator, etc.) may supply electrical power to various equipment of the wellsite system 100, including the memory device 154, the surface controller 156, the tool string 110, the conveyance device 140, and/or the winch conveyance device 144. The surface controller 156 (e.g., a processing device, a computer, etc.) may store executable programs and/or instructions, including for implementing one or more aspects of methods, processes, and operations described herein. The surface controller 156 may be communicatively connected with various equipment of the wellsite system 100, such as may permit the surface controller 156 to monitor operations of one or more portions of the wellsite system 100 and/or to provide automatic control of one or more portions of the wellsite system 100, including the electrical power source 152, the tool string 110, the conveyance device 140, and/or the winch conveyance device 144. The surface controller 156 may also or instead be used by wellsite personnel (i.e., a human operator) to manually control one or more portions of the wellsite system 100, including the tool string 110, the conveyance device 140, and/or the winch conveyance device 144. The surface controller 156 may include input devices (e.g., a joystick, a keyboard, etc.) for receiving commands from the wellsite personnel and output devices (e.g., a video monitor, audio speakers, etc.) for displaying information to the wellsite personnel.

A production tubing string 124 may be installed within the wellbore 102, defining an annulus 107 (i.e., an annular space) between an inner surface of the casing string 108 and an outer surface of the production tubing 124. A plurality of gas lift mandrels 126 (e.g., side pocket mandrels) (only one shown) may form portions of or be coupled along the production tubing 124. Each gas lift mandrel 126 may comprise a side pocket 127 laterally (or radially) offset from a main production bore 125 of the production tubing 124 (including the gas lift mandrel 126) and configured to receive or otherwise hold a gas lift valve 111 for injecting a gas (e.g., nitrogen) into the production tubing 124 during hydrocarbon production operations. The gas lift valve 111 may be installed within (e.g., inserted into) a gas lift valve receptacle 121 (e.g., a port or seat) within the side pocket 127. The gas may be injected into the annulus 107 at the wellsite surface 104 via the wellhead 134 or one of the fluid control devices 132 and transferred downhole via the annulus 107. The gas may then pass into each gas lift valve 111 via an opening 129 extending through a wall of the gas lift mandrel 126 between the annulus 107 and the side pocket 127 containing the gas lift valve 111. Each gas lift valve 111 may inject the gas into the main production bore 125 of the production tubing 124 to decrease the density of the formation fluid within the production tubing 124 to thereby increase flow rate of the formation fluid to the wellsite surface 104. Each gas lift mandrel 126 may further comprise a latching feature 123 (e.g., a receptacle, a recess, a shoulder, etc.) within, extending into, extending out of, or otherwise located on an inner surface of the gas lift mandrel 126 along the main production bore 125.

The tool string 110 may be conveyed within the wellbore 102 through the production tubing 124 to perform various intervention and other downhole operations. The tool string 110 may comprise one or more downhole tools 114 (e.g., devices, modules, subs, etc.) operable to perform such downhole operations. The conductor 122 may extend through or along at least a portion of the tool string 110, such as to communicatively and/or electrically connect one or more downhole tools 114 of the tool string 110 with the power and control system 150. The conductor 122 extending through the tool string 110 may also facilitate electrical communication between two or more of the downhole tools 114. One or more of the downhole tools 114 may comprise corresponding electrical conductors, connectors, and/or interfaces forming a portion of the conductor 122 extending through the tool string 110. The conductor 122 may extend through the conveyance line 120 and externally from the conveyance line 120 at the wellsite surface 104 via a rotatable joint or coupling (e.g., a collector) (not shown) carried by the drum 146.

The tools 114 of the tool string 110 may comprise a cable head 112 (e.g., a logging head, a cable termination sub, etc.) operable to physically and/or electrically connect the conveyance line 120 to the tool string 110. The cable head 112 may permit the tool string 110 to be suspended and conveyed within the wellbore 102 via the conveyance line 120. The tools 114 may be or comprise one or more of a jarring tool, a stroker tool, and a release tool. The tools 114 may be or comprise a telemetry tool, such as may facilitate communication between the tool string 110 and the surface controller 156. The tools 114 may be or comprise one or more inclination and/or directional sensors, such as one or more accelerometers, magnetometers, gyroscopic sensors (e.g., micro-electro-mechanical system (MEMS) gyros), and/or other sensors for determining the orientation and/or direction of the tool string 110 within the wellbore 102. The tools 114 may be or comprise a depth correlation tool, such as a casing collar locator (CCL) tool for detecting the ends of casing collars by sensing a magnetic irregularity caused by the relatively high mass of an end of a collar of the casing 108. The depth correlation tool may also or instead be or comprise a gamma ray (GR) tool that may be utilized for depth correlation.

One or more of the tools 114 may comprise a downhole controller 116 communicatively connected with the surface controller 156 via the conductor 122 and with other portions of the tool string 110. Each downhole controller 116 may be further operable to store and/or communicate to the surface controller 156 signals or information generated by one or more sensors or instruments of the tool string 110. Each downhole controller 116 may be operable to control one or more portions of the tool string 110. For example, a downhole controller 116 may be operable to receive, store, and/or process control commands from the surface controller 156 for controlling one or more tools 114 of the tool string 110.

The tool string 110 may comprise a kickover tool 160 operable to retrieve a used (or old) gas lift valve 111 from the side pocket 127 of the gas lift mandrel 126 and to install a new (or unused) gas lift valve 113 within the side pocket 127 of the gas lift mandrel 126. The kickover tool 160 may comprise an upper kickover tool portion 162 (e.g., a sub, a module, etc.) and a lower kickover tool portion 164 (e.g., a sub, a module, etc.). The upper kickover tool portion 162 and the lower kickover tool portion 164 may be detachably coupled (e.g., threadedly connected), permanently coupled (e.g., welded together), or otherwise fixedly connected together. The upper kickover tool portion 162 may be operable to retrieve the used gas lift valve 111 from the side pocket 127 of the gas lift mandrel 126 and the lower kickover tool portion 164 may be operable to install the new gas lift valve 113 within the side pocket 127 of the gas lift mandrel 126.

Although the tool string 110 is shown comprising two downhole tools 114, it is to be understood that the tool string 110 may be implemented with a lesser or greater quantity of downhole tools 114 connected above and/or below the kickover tool 160. However, it is to be further understood that the tool string 110 may be implemented without downhole tools 114, such that the cable head 112 is connected directly to the kickover tool 160.

The kickover tool 160 may comprise a housing 166 defining or otherwise encompassing a plurality of internal spaces or volumes containing various components of the kickover tool 160. The housing 166 may be or comprise a housing assembly comprising an upper housing of the upper kickover tool portion 162 and a lower housing of the lower kickover tool portion 164 coupled together to form the housing 166. The upper kickover tool portion 162 may comprise an upper holder 170 configured to connect to and hold the used gas lift valve 111 and an upper displacement mechanism 172 operable to (e.g., laterally or radially) move the upper holder 170 between a retracted position in which the upper holder 170 is adjacent the housing 166 and an extended position in which the upper holder 170 is spaced away from the housing 166. The lower kickover tool portion 164 may comprise a lower holder 174 configured to connect to and hold the new gas lift valve 113 and a lower displacement mechanism 176 operable to move the lower holder 174 between a retracted position in which the lower holder 174 is adjacent the housing 166 and an extended position in which the lower holder 174 is spaced away from the housing 166.

To perform gas lift valve retrieval operations, the tool string 110 (including the kickover tool 160) may be conveyed downhole by one or more of the conveyance device 140 and the wench conveyance device 144 to a predetermined gas lift mandrel 126 such that the upper kickover tool portion 162 is positioned adjacent the side pocket 127 of the gas lift mandrel 126. The upper displacement mechanism 172 may then be operated to move the upper holder 170 (which is empty) to the extended position into the side pocket 127. Operation of the upper displacement mechanism 172 may be triggered by raising (or conveying uphole) the tool string 110 until a latch 178 of the upper displacement mechanism 172 engages (e.g., enters, latches against, contacts, etc.) the latching feature 123 of the gas lift mandrel 126. The tool string 110 may then be lowered (or conveyed downhole) along the wellbore 102 until the upper holder 170 connects with the used gas lift valve 111 installed within the side pocket 127 of the gas lift mandrel 126. The tool string 110 may then be raised to withdraw or otherwise disconnect the used gas lift valve 111 from the receptacle 121 and to cause the upper displacement mechanism 172 to move the upper holder 170 with the used gas lift valve 111 from the extended position to the retracted position to dispose the used gas lift valve 111 within the upper housing of the upper kickover tool portion 162.

To perform gas lift valve installation operations, the tool string 110 may continue to be raised such that the lower kickover tool portion 164 is positioned adjacent the side pocket 127 of the gas lift mandrel 126. The lower displacement mechanism 176 may then be operated to move the lower holder 174, which holds the new gas lift valve 113, to the extended position into the side pocket 127. Operation of the lower displacement mechanism 176 may be triggered by raising the tool string 110 until a latch 179 of the lower displacement mechanism 176 engages the latching feature 123 of the gas lift mandrel 126. The tool string 110 may then be lowered along the wellbore 102 until the lower holder 174 installs (e.g., inserts) the new gas lift valve 113 within the receptacle 121 of the side pocket 127. The tool string 110 may then be raised to cause the lower displacement mechanism 176 to move the lower holder 174 from the extended position to the retracted position. The tool string 110 may then be conveyed uphole until the tool string 110, including the kickover tool 160 and the used gas lift valve 111, are retrieved to the wellsite surface 104.

Figure 2:
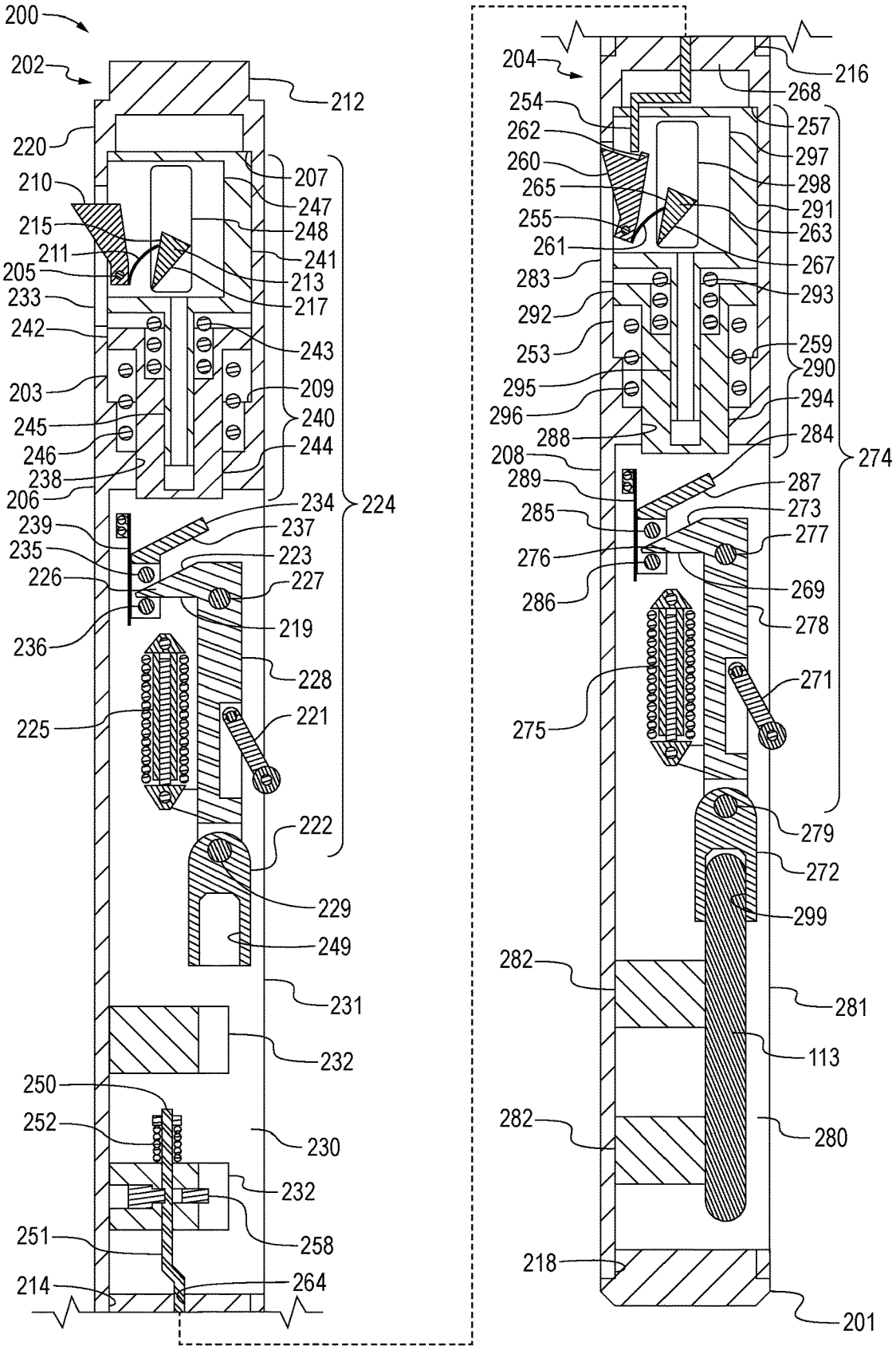
FIG. 2 is a side sectional view of at least a portion of an example implementation of apparatus according to one or more aspects of the present disclosure.

FIG. 2 is a schematic sectional view of at least a portion of an example implementation of a kickover tool 200 according to one or more aspects of the present disclosure. The kickover tool 200 may be operable to perform gas lift valve retrieval and installation operations (collectively "downhole operations") according to one or more aspects of the present disclosure. The kickover tool 200 may be an example implementation of the kickover tool 160 described above and shown in FIG. 1 and may comprise one or more features and/or modes of operation of the kickover tool 160. Accordingly, the following description refers to FIGS. 1 and 2, collectively.

The kickover tool 200 may be operable to retrieve a used (or old) gas lift valve 111 from a side pocket 127 of a gas lift mandrel 126 and to install a new gas lift valve 113 within the side pocket 127 of the gas lift mandrel 126. The kickover tool 200 may comprise an upper kickover tool portion 202 (e.g., a sub, a module, etc.) and a lower kickover tool portion 204 (e.g., a sub, a module, etc.). The kickover tool portion 202 and the kickover tool portion 204 may be detachably coupled (e.g., threadedly connected), permanently coupled (e.g., welded together), or otherwise fixedly connected together. The kickover tool portion 202 may be operable to retrieve the used gas lift valve 111 from the side pocket 127 of the gas lift mandrel 126 and the kickover tool portion 204 may be operable to install the new gas lift valve 113 within the side pocket 127 of the gas lift mandrel 126.

The kickover tool portion 202 may comprise a housing (or body) portion 206 defining or otherwise encompassing a plurality of internal spaces or volumes containing various components of the kickover tool portion 202. The kickover tool portion 204 may comprise a housing (or body) portion 208 defining or otherwise encompassing a plurality of internal spaces or volumes containing various components of the kickover tool portion 204. Although each housing portion 206, 208 is shown as comprising a single unitary member, it is to be understood that each housing portion 206, 208 may be or comprise a housing assembly having a plurality of housing sections coupled together to form each housing portion 206, 208.

An upper (uphole) end of the kickover tool portion 202 may include an upper interface, a crossover, and/or other coupler 212 for mechanically coupling the kickover tool portion 202 (and the entire kickover tool 200) with a corresponding interface (not shown) of a cable head 112 or a downhole tool 114 of a tool string 110. A lower (downhole) end of the kickover tool portion 202 may include a lower interface, a crossover, and/or other coupler 214. Each coupler 212, 214 may be a part of the housing portion 206 or directly or indirectly coupled with the housing portion 206, such as via a threaded connection. An upper end of the kickover tool portion 204 may include an upper interface, a crossover, and/or other coupler 216 for mechanically coupling the kickover tool portion 204 with the lower coupler 214 of the kickover tool portion 202 to mechanically connect (or couple) the kickover tool portion 202 with the kickover tool portion 204. Such mechanical connection may be a fixed connection (e.g., a welded connection), which does not permit relative motion between the kickover tool portion 202 and the kickover tool portion 204. Such mechanical connection may also be a detachable connection (e.g., threaded connection), which permits disconnection between the kickover tool portion 202 and the kickover tool portion 204, such as via a manual tool (e.g., a wrench). A lower end of the kickover tool portion 204 may include a lower interface, a crossover, and/or other coupler 218. The lower coupler 218 may be used to mechanically connect the kickover tool portion 204 with an end cap 201 of the kickover tool 200. However, the lower coupler 218 may instead be used to mechanically connect the kickover tool portion 204 (and the entire kickover tool 200) with a corresponding interface of a downhole tool (e.g., a downhole tool 114), if additional downhole tools are intended to be coupled below (downhole from) the kickover tool 200. The couplers 216, 218 may be a part of the housing portion 208 or directly or indirectly coupled with the housing portion 208, such as via a threaded connection. Because the housing portion 206 of the kickover tool portion 202 and the housing portion 208 of the kickover tool portion 204 are fixedly connected via the couplers 214, 216, the housing portion 206 and the housing portion 208 may collectively be or form a housing (or housing assembly) 220 of the kickover tool 200.

The kickover tool portion 202 may comprise an upper holder 222 (i.e., a grabber, a knuckle, etc.) configured to receive and hold the used gas lift valve 111. For example, the holder 222 may comprise a receptacle 249 configured to receive and hold (or couple with) an end of the used gas lift valve 111. The kickover tool portion 202 may further comprise an upper displacement mechanism (or system) 224 operable to move the holder 222 between a retracted (i.e., run-in) position (shown in FIGS. 2, 3, and 7-9), in which the holder 222 is disposed adjacent or within the housing portion 206 of the housing 220, and an extended (i.e., deployed, displaced, etc.) position (shown in FIGS. 4-6), in which the holder 222 is laterally (or radially) offset or otherwise disposed away (i.e., spaced away) from the housing portion 206 of the housing 220.

At least a portion of the displacement mechanism 224 may be disposed within or surrounded by the housing portion 206 of the housing 220. The displacement mechanism 224 may comprise an upper arm 228 pivotably connected to the housing portion 206 and carrying the holder 222. Although the arm 228 is shown as comprising a single unitary member, it is to be understood that the arm 228 may be or comprise an arm assembly having a plurality of arm sections coupled together to form the arm 228. The arm 228 may be pivotably connected to the housing portion 206 at an upper end of the arm 228. The holder 222 may be pivotably connected with the arm 228 at a lower end of the arm 228. The arm 228 may be pivotably connected with the housing portion 206 at an upper pivot point located at the upper end of the arm 228. The upper pivot point may be defined by an upper pivot pin 227 extending through at least a portion of the housing portion 206 and the arm 228 to pivotably connect the arm 228 to the housing portion 206. The holder 222 may be pivotably connected with the arm 228 at a lower pivot point located at the lower end of the arm 228. The lower pivot point may be defined by a lower pivot pin 229 extending through at least a portion of the holder 222 and the arm 228 to pivotably connect the holder 222 to the arm 228.

The kickover tool portion 202 may further comprise an upper cavity 230 (e.g., a slot, a channel, a receptacle, or other open space) extending into the housing portion 206 and configured to accommodate (i.e., receive and store) the used gas lift valve 111. The cavity 230 may be defined at least partially by the housing portion 206 and an upper opening 231 extending laterally (or radially) through a sidewall of the housing portion 206 and longitudinally along the housing portion 206. The cavity 230 may extend below the arm 228 and the holder 222 to accommodate the used gas lift valve 111 while the kickover tool 200 is conveyed within the wellbore 102. The cavity 230 may contain a plurality of saddles (or holders) 232, each configured to receive and hold the used gas lift valve 111 within the cavity 230 while the used gas lift valve 111 is held by the holder 222.

While the displacement mechanism 224 maintains the holder 222 in the retracted position, the arm 228, the holder 222, and the used gas lift valve 111 (when connected to the holder 222) may each be axially aligned with or parallel to a longitudinal axis (e.g., a central axis) of the kickover tool 200 such that the arm 228, the holder 222, and the used gas lift valve 111 are disposed within the cavity 230, with the used gas lift valve 111 being disposed within (or held by) the saddles 232. While the displacement mechanism 224 maintains the holder 222 in the extended position, the arm 228 may extend (i.e., protrude) laterally away from the housing portion 206 via the opening 231 of the cavity 230 and the holder 222 may be outside of the cavity 230 and laterally (or radially) offset from the housing portion 206, and disposed within the side pocket 127 of the gas lift mandrel 126 such that the holder 222 is axially aligned with the receptacle 121 of the side pocket 127. Such positioning may permit the holder 222 to connect with (i.e. grab and hold) the used gas lift valve 111 installed within the side pocket 127, thereby permitting the used gas lift valve 111 to be retrieved to the wellsite surface 104.

The displacement mechanism 224 may further comprise a biasing member 225 disposed in association with the arm 228. The biasing member 225 may be configured to bias (or urge) the arm 228 from a retracted (i.e., run-in) position (shown in FIGS. 2, 3, and 7-9), in which the arm 228 extends substantially parallel to or longitudinally along or within the housing portion 206, toward an extended (i.e., deployed, pivoted, etc.) position (shown in FIGS. 4-6), in which the arm 228 extends laterally (e.g., diagonally) through the opening 231 and away from or otherwise with respect to the housing portion 206. The arm 228 may be operable to move the holder 222 from the retracted position to the extended position, such that when the arm 228 is in the retracted position, the holder 222 is also in the retracted position, and when the arm 228 is in the extended position, the holder 222 is also in the extended position. The biasing member 225 may comprise a coiled spring disposed in association with (e.g., within, around, etc.) telescoping guide members. An upper end of the biasing member 225 may be pivotably connected to the housing portion 206 and a lower end of the biasing member 225 may be pivotably connected to the arm 228. The upper end of the biasing member 225 may push against the housing portion 206 and the lower end of the biasing member 225 may push against the arm 228 to therefore bias the arm 228 from the retracted position toward the extended position during the downhole operations.

The arm 228 may comprise or be fixedly connected with a latch 226 at the upper end of the arm 228. The latch 226 may be located adjacent the pivot pin 227 and extend laterally (e.g., perpendicularly) from the arm 228. The latch 226 may comprise opposing upper and lower contact surfaces (or edges) 219, 223. The upper contact surface 223 may extend diagonally (or slantwise) with respect to the arm 228 and the lower contact surface 219 may extend perpendicularly with respect to the arm 228.

The displacement mechanism 224 may also comprise another biasing member (or system) 221 carried by or otherwise disposed in association with the arm 228. The biasing member 221 may be or comprise an arm pivotably connected to the arm 228 at one end and having a rotating member (e.g., a roller, a wheel, a ball bearing, etc.) or other friction reducing member (e.g., a friction reducing plate) configured to contact an inner surface of the production tubing 124 at the opposing end. The biasing member 221 may be operable to push against the inner surface of the production tubing 124 to therefore bias (or push) the arm 228 to the retracted position and/or to reduce friction between the arm 228 and the production tubing 124 after the arm 228 moves to the extended position and when the kickover tool 200 is being conveyed through the production tubing 124.

The displacement mechanism 224 may further comprise an upper latching mechanism (or system) 234 movably connected to the housing portion 206 and operable to engage with the arm 228 to prevent the arm 228 from pivoting from the retracted position to the extended position, thereby preventing the arm 228 from moving the holder 222 from the retracted position to the extended position. The latching mechanism 234 may be pivotably connected to the housing portion 206 via a pivot pin 235 and comprise a latch 236 (e.g., a pin, a roller, a bracket, or other keeper) operable to engage the latch 226 to thereby prevent the arm 228 from pivoting. The latching mechanism 234 may further comprise a movable member 237 (e.g., a lever, an arm, a button, etc.) configured to be moved (e.g., pushed, pressed, etc.) or otherwise physically operated to cause the latching mechanism 234 to pivot about the pivot pin 235 to cause the latch 236 to move from a latching position (shown in FIGS. 2, 3, and 6-9), in which the latch 236 can engage the latch 226 of the arm 228 to maintain the arm 228 in the retracted position, to an unlatching position (shown in FIGS. 4 and 5), in which the latch 236 cannot engage (or is disengaged from) the latch 226 and, thus, permit the arm 228 to move from the retracted position to the extended position. The latching mechanism 234 may thus be referred to as an arm release mechanism or an arm trigger mechanism. The latching mechanism 234 may be biased toward the latching position by a biasing member 239 (e.g., a leaf spring, a compression spring, etc.) disposed in association with the latching mechanism 234.

The housing portion 206 may further comprise or otherwise define an upper chamber 203 (i.e., an open space) containing a portion of the displacement mechanism 224. The chamber 203 may be located above (uphole from) the cavity 230 and be connected with or extend to the cavity 230 via a passage (or bore) 238 extending through a lateral wall of the housing portion 206. The displacement mechanism 224 may further comprise an upper carriage assembly 240 slidably or otherwise movably disposed within the housing portion 206. The carriage assembly 240 may be slidably or otherwise movably disposed within the chamber 203 and operable to extend into the cavity 230 of the housing portion 206 via the passage 238. Various portions of the chamber 203 may each have a cylindrical geometry, and various portions of the carriage assembly 240 may each have a cylindrical geometry sized to slidably engage an inner surface of a corresponding portion of the chamber 203.

The carriage assembly 240 may comprise an upper movable member or portion and a lower movable member or portion, each operable to move with respect to the other. For example, the upper movable member may be or comprise a carriage 241 and the lower movable member may be or comprise a piston (or ring) 242. The carriage assembly 240 may further comprise a biasing member 243 between the carriage 241 and the piston 242. The carriage 241 and the piston 242 may each contact and slide along an inner surface of the housing portion 206 defining the chamber 203. The piston 242 may comprise or be connected to a pusher rod 244. The carriage 241 may comprise or be connected to a rod 245 telescopically positioned within a bore of the pusher rod 244, permitting relative sliding movement of the carriage 241 and the piston 242 between an extended position (shown in FIGS. 4 and 5), in which the carriage 241 and the piston 242 are separated by a predetermined distance, and a retracted position (shown in FIGS. 2, 3, and 6-9), in which the carriage 241 and the piston 242 abut or are otherwise in contact. The biasing member 243 may bias the carriage 241 and the piston 242 toward the extended position. The carriage 241 may comprise or otherwise define a chamber 247 (i.e., an open space).

The displacement mechanism 224 may further comprise a contact member 213 fixedly connected to the housing portion 206 such that the contact member is movable with the housing portion 206. The contact member 213 may extend laterally (e.g., perpendicularly) into or through the chamber 203 and into or through the chamber 247 via one or more windows (or openings) 248 extending through a wall of the carriage 241. The contact member 213 may comprise opposing contact surfaces (or edges) 215, 217, which may extend at an acute angle with respect to each other. The contact surfaces 215, 217 may converge at a lower end (or edge) of the contact member 213. During the downhole operations, when the housing 220 moves upward (uphole) within the production tubing 124, the contact member 213 also moves upward with the housing portion 206 of the housing 220 through the chamber 247 along the window 248.

The carriage assembly 240 may be operatively connected to the housing portion 206 via a biasing member (or member) 246. The carriage assembly 240 may be movable with respect to the housing portion 206 and within the chamber 203 between a retracted position (shown in FIGS. 2, 3, and 6-9), in which the carriage assembly 240 does not permit the arm 228 to move the holder 222 from the retracted position to the extended position, and an extended position (shown in FIGS. 4 and 5), in which the carriage assembly 240 permits the arm 228 to move the holder 222 from the retracted position to the extended position. In the retracted position of the carriage assembly 240, a feature (e.g., an upper end, an upper shoulder, etc.) of the carriage 241 abuts or otherwise contacts a corresponding upper feature 207 (e.g., an upper shoulder) of the housing portion 206 along the chamber 203, and in the extended position of the carriage assembly 240, a feature (e.g., a lower end, a lower shoulder, etc.) of the piston 242 abuts or otherwise contacts a corresponding lower feature 209 (e.g., a lower shoulder) of the housing portion 206 along the chamber 203. In the retracted position of the carriage assembly 240, the pusher rod 244 does not extend into the cavity 230 via the passage 238 and is therefore spaced away from the movable member 237 of the latching mechanism 234 by a predetermined distance, thereby permitting the biasing member 239 to maintain the latching mechanism 234 in the latching position. In the extended position of the carriage assembly 240, the pusher rod 244 extends into the cavity 230 via the passage 238 and pushes or otherwise contacts the movable member 237 of the latching mechanism 234, thereby moving the latching mechanism 234 to the unlatching position. The biasing member 246 may bias the carriage assembly 240 toward the retracted position and, thus, bias the pusher rod 244 to be spaced away from the movable member 237 of the latching mechanism 234. Accordingly, relative movement between the carriage assembly 240 and the housing portion 206 may cause the carriage assembly 240 to move the latching mechanism 234 to the unlatching position, causing the latches 226, 236 to disengage (or unlatch) to thereby permit the arm 228 to pivot from the retracted position to the extended position and, thus, move the holder 222 from the retracted position to the extended position. The biasing member 243 may be stiffer than the biasing member 246, such that the carriage assembly 240 moves to the extended position within and out of the chamber 203 before the carriage 241 moves to the retracted position with respect to the piston 242.

The displacement mechanism 224 may further comprise an upper latch (or trigger) 210 movably connected to the carriage assembly 240. The latch 210 may be pivotably connected to the carriage 241 at a pivot point defined by a pivot pin 205, permitting the latch 210 to pivot to selectively extend out (shown in FIGS. 2-5) of the housing portion 206 via a slot opening 233 in the housing portion 206 and to retract (shown in FIGS. 6-9) into the chamber 247 of the carriage 241 and the housing portion 206. The latch 210 may be operable to engage (e.g., enter, lock with, latch against, etc.) the latching feature 123 located along the main bore 125 of the gas lift mandrel 126 when the kickover tool 200 moves through the main bore 125 of the gas lift mandrel 126. During the downhole operations, after the latch 210 engages the latching feature 123, the latch 210 may cause the carriage assembly 240 to remain static with respect to the gas lift mandrel 126 while the housing 220 and items connected to the housing 220 (including the contact member 213) move upward with the housing 220. During the downhole operations, after the latch 210 engages the latching feature 123, the contact member 213 may be operable to maintain the latch 210 in the extended position when the carriage assembly 240 moves from the retracted position to the extended position, and to move the latch 210 from the extended position to the retracted position when the carriage assembly 240 moves from the extended position to the retracted position.

The latch 210 may be biased by a biasing member 211 (e.g., a leaf spring) to extend out of the housing portion 206. The biasing member 211 may operatively (or communicatively) connected the latch 210 with the contact member 213. For example, one end of the biasing member 211 may be connected to the latch 210 and the opposing end of the biasing member 211 may be free, extending laterally or otherwise away from the latch 210 and be disposed against (in contact with) the contact member 213. The free end of the biasing member 211 may push the contact surface 215 of the contact member 213 to pivotably bias the latch 210 toward the extended position to thereby maintain the latch 210 in the extended position. Thus, during the downhole operations when the housing 220 moves upward within the gas lift mandrel 126 and the contact member 213 moves upward along the window 248, the free end of the biasing member 211 may slide against the contact surface 215 of the contact member 213 while the carriage assembly 240 moves (or slides) with respect to the housing portion 206 from the retracted position to the extended position to bias the latch 210 toward the extended position. The contact surface 215 may extend diagonally (or slantwise) toward the latch 210 (and the biasing member 211) in the downward (downhole) direction. Thus, during the downhole operations when the housing 220 moves upward within the gas lift mandrel 126 and the contact member 213 moves upward along the window 248, the contact surface 215 of the contact member 213 may push the free end of the biasing member 211 progressively closer to the latch 210, thereby flexing the free end of the biasing member 211 progressively closer to the latch 210. After the free end of the biasing member 211 slides off of the contact surface 215 of the contact member 213, the biasing member 211 does not contact the contact member 213 and, thus, cannot bias the latch 210 to the extended position, thereby permitting the latch 210 to move from the extended position to the retracted position. After the free end of the biasing member 211 slides off of the contact surface 215 of the contact member 213, the free end of the biasing member 211 may extend away from the latch 210 past the lower end of the contact member 213 such that the free end of the biasing member 211 is below the opposing contact surface 217. Thereafter, during the downhole operations when the housing 220 moves downward within the gas lift mandrel 126 and the contact member 213 moves downward along the window 248, the free end of the biasing member 211 may slide against the contact surface 217 of the contact member 213 or otherwise contact the contact member 213 while the biasing member 246 moves the carriage assembly 240 with respect to the housing portion 206 from the extended position to the retracted position to therefore move (or pivot) the latch 210 from the extended position to the retracted position. Thereafter, the contact member 213 may maintain the latch 210 in the retracted position when the carriage assembly 240 is maintained in the retracted position.

The kickover tool portion 204 may comprise features and modes of operation of the kickover tool portion 202. The kickover tool portion 204 may comprise a lower holder 272 (i.e., a grabber, a knuckle, etc.) configured to receive and hold the new gas lift valve 113. For example, the holder 272 may comprise a receptacle 299 configured to receive and hold (or couple with) an end of the new gas lift valve 113. The kickover tool portion 204 may further comprise a lower displacement mechanism (or system) 274 operable to move the holder 272 between a retracted (i.e., run-in) position (shown in FIGS. 2-7), in which the holder 272 is disposed adjacent or within the housing portion 208 of the housing 220, and an extended (i.e., deployed, displaced, etc.) position (shown in FIGS. 8 and 9), in which the holder 272 is laterally (or radially) offset or otherwise disposed away (i.e., spaced away) from the housing portion 208 of the housing 220.

At least a portion of the displacement mechanism 274 may be disposed within or surrounded by the housing portion 208. The displacement mechanism 274 may comprise a lower arm 278 pivotably connected to the housing portion 208 and carrying the holder 272. Although the arm 278 is shown as comprising a single unitary member, it is to be understood that the arm 278 may be or comprise an arm assembly having a plurality of arm sections coupled together to form the arm 278. The arm 278 may be pivotably connected to the housing portion 208 at an upper end of the arm 278. The holder 272 may be pivotably connected with the arm 278 at a lower end of the arm 278. The arm 278 may be pivotably connected with the housing portion 208 at an upper pivot point located at the upper end of the arm 278. The upper pivot point may be defined by an upper pivot pin 277 extending through at least a portion of the housing portion 208 and the arm 278 to pivotably connect the arm 278 to the housing portion 208. The holder 272 may be pivotably connected with the arm 278 at a lower pivot point located at the lower end of the arm 278. The lower pivot point may be defined by a lower pivot pin 279 extending through at least a portion of the holder 272 and the arm 278 to pivotably connect the holder 272 to the arm 278.

The kickover tool portion 204 may further comprise a lower cavity 280 (e.g., a slot, a channel, a receptacle, or other open space) extending into the housing portion 208 and configured to accommodate (i.e., receive and store) the new gas lift valve 113. The cavity 280 may be defined at least partially by the housing portion 208 and a lower opening 281 extending laterally (or radially) through a sidewall of the housing portion 208 and longitudinally along the housing portion 208. The cavity 280 may extend below the arm 278 and the holder 272 to accommodate the new gas lift valve 113 while the kickover tool 200 is conveyed within the wellbore 102. The cavity 280 may contain a plurality of saddles (or holders) 282, each configured to receive and hold the new gas lift valve 113 within the cavity 280 while the new gas lift valve 113 is held by the holder 272.

While the displacement mechanism 274 maintains the holder 272 in the retracted position, the arm 278, the holder 272, and the new gas lift valve 113 (when connected to the holder 272) may each be axially aligned with or parallel to a longitudinal axis (e.g., a central axis) of the kickover tool 200 such that the arm 278, the holder 272, and the new gas lift valve 113 are disposed within the cavity 280, with the new gas lift valve 113 being disposed within (or held by) the saddles 282. While the displacement mechanism 274 maintains the holder 272 in the extended position, the arm 278 may extend (i.e., protrude) laterally away from the housing portion 208 via the opening 281 of the cavity 280 and the holder 272 may be outside of the cavity 280 and laterally (or radially) offset from the housing portion 208, and disposed within the side pocket 127 of the gas lift mandrel 126 such that the holder 272 is axially aligned with the receptacle 121 of the side pocket 127. Such positioning may permit the new gas lift valve 113 held by the holder 272 to be installed within the receptacle 121 of the side pocket 127.

The displacement mechanism 274 may further comprise a biasing member 275 disposed in association with the arm 278. The biasing member 275 may be configured to bias the arm 278 from a retracted (i.e., run-in) position (shown in FIGS. 2-7), in which the arm 278 extends substantially parallel to or longitudinally along or within the housing portion 208, toward an extended (i.e., deployed, pivoted, etc.) position (shown in FIGS. 8 and 9), in which the arm 278 extends laterally (e.g., diagonally) through the opening 281 and away from or otherwise with respect to the housing portion 208. The arm 278 may be operable to move the holder 272 from the retracted position to the extended position, such that when the arm 278 is in the retracted position, the holder 272 is also in the retracted position, and when the arm 278 is in the extended position, the holder 272 is also in the extended position. The biasing member 275 may comprise a coiled spring disposed in association with (e.g., within, around, etc.) telescoping guide members. An upper end of the biasing member 275 may be pivotably connected to the housing portion 208 and a lower end of the biasing member 275 may be pivotably connected to the arm 278. The upper end of the biasing member 275 may push against the housing portion 208 and the lower end of the biasing member 275 may push against the arm 278 to therefore bias the arm 278 from the retracted position toward the extended position during the downhole operations.

The arm 278 may comprise or be fixedly connected with a latch 276 at the upper end of the arm 278. The latch 276 may be located adjacent the pivot pin 277 and extend laterally (e.g., perpendicularly) from the arm 278. The latch 276 may comprise opposing upper and lower contact surfaces (or edges) 269, 273. The upper contact surface 273 may extend diagonally (or slantwise) with respect to the arm 278 and the lower contact surface 269 may extend perpendicularly with respect to the arm 278.

The displacement mechanism 274 may also comprise another biasing member 271 carried by or otherwise disposed in association with the arm 278. The biasing member 271 may be or comprise an arm pivotably connected to the arm 278 at one end and having a rotating member (e.g., a roller, a wheel, a ball bearing, etc.) or other friction reducing member (e.g., a friction reducing plate) configured to contact an inner surface of the production tubing 124 at the opposing end. The biasing member 271 may be operable to push against the inner surface of the production tubing 124 to therefore bias (or push) the arm 278 to the retracted position and/or to reduce friction between the arm 278 and the production tubing 124 after the arm 278 moves to the extended position and when the kickover tool 200 is being conveyed through the production tubing 124.

The displacement mechanism 274 may further comprise a lower latching mechanism (or system) 284 movably connected to the housing portion 208 and operable to engage with the arm 278 to prevent the arm 278 from pivoting from the retracted position to the extended position, thereby preventing the arm 278 from moving the holder 272 from the retracted position to the extended position. The latching mechanism 284 may be pivotably connected to the housing portion 208 via a pivot pin 285 and comprise a latch 286 (e.g., a pin, a roller, a bracket, or other keeper) operable to engage the latch 276 to thereby prevent the arm 278 from pivoting. The latching mechanism 284 may further comprise a movable member 287 (e.g., a lever, an arm, a button, etc.) configured to be moved (e.g., pushed, pressed, etc.) or otherwise physically operated to cause the latching mechanism 284 to pivot about the pivot pin 285 to cause the latch 286 to move from a latching position (shown in FIGS. 1-7 and 9), in which the latch 286 can engage the latch 276 of the arm 278 to maintain the arm 278 in the retracted position, to an unlatching position (shown in FIG. 8), in which the latch 286 cannot engage (or is disengaged from) the latch 276 and, thus, permit the arm 278 to move from the retracted position to the extended position. The latching mechanism 284 may thus be referred to as an arm release mechanism or an arm trigger mechanism. The latching mechanism 284 may be biased toward the latching position by a biasing member 289 (e.g., a leaf spring, a compression spring, etc.) disposed in association with the latching mechanism 284.

The housing portion 208 may further comprise or otherwise define a lower chamber 253 (i.e., an open space) containing a portion of the displacement mechanism 274. The chamber 253 may be located above the cavity 280 and be connected with or extend to the cavity 280 via a passage (or bore) 288 extending through a lateral wall of the housing portion 208. The displacement mechanism 274 may further comprise a lower carriage assembly 290 slidably or otherwise movably disposed within the housing portion 208. The carriage assembly 290 may be slidably or otherwise movably disposed within the chamber 253 and operable to extend into the cavity 280 of the housing portion 208 via the passage 288. Various portions of the chamber 253 may each have a cylindrical geometry, and various portions of the carriage assembly 290 may each have a cylindrical geometry sized to slidably engage an inner surface of a corresponding portion of the chamber 253.

The carriage assembly 290 may comprise an upper movable member or portion and a lower movable member or portion, each operable to move with respect to the other. For example, the upper movable member may be or comprise a carriage 291 and the lower movable member may be or comprise a piston (or ring) 292, each operable to move with respect to the other. A biasing member 293 may be disposed between the carriage 291 and the piston 292. The carriage 291 and the piston 292 may each contact and slide along an inner surface of the housing portion 208 defining the chamber 253. The piston 292 may comprise or be connected to a pusher rod 294. The carriage 291 may comprise or be connected to a rod 295 telescopically positioned within a bore of the pusher rod 294, permitting relative sliding movement of the carriage 291 and the piston 292 between an extended position (shown in FIG. 8), in which the carriage 291 and the piston 292 are separated by a predetermined distance, and a retracted position (shown in FIGS. 2-7 and 9), in which the carriage 291 and the piston 292 abut or are otherwise in contact. The biasing member 293 may bias the carriage 291 and the piston 292 toward their extended position. The carriage 291 may comprise or otherwise define a chamber 297 (i.e., an open space).

The displacement mechanism 274 may further comprise a contact member 263 fixedly connected to the housing portion 208 such that the contact member 263 is movable with the housing portion 208. The contact member 263 may extend laterally (e.g., perpendicularly) into or through the chamber 253 and into or through the chamber 297 via one or more windows (or openings) 298 extending through a wall of the carriage 291. The contact member 263 may comprise opposing contact surfaces (or edges) 265, 267, which may extend at an acute angle with respect to each other. The contact surfaces 265, 266 may converge at a lower end (or edge) of the contact member 263. During the downhole operations, when the housing 220 moves upward within the gas lift mandrel 126, the contact member 263 also moves upward with the housing portion 208 of the housing 220 through the chamber 297 along the window 298.

The carriage assembly 290 may be operatively connected to the housing portion 208 via a biasing member 296. The carriage assembly 290 may be movable with respect to the housing portion 208 and within the chamber 253 between a retracted position (shown in FIGS. 2-7 and 9), in which a feature (e.g., an upper end, an upper shoulder, etc.) of the carriage 291 abuts or otherwise contacts a corresponding upper feature 257 (e.g., an upper shoulder) of the housing portion 208 along the chamber 253, and an extended position (shown in FIG. 8), in which a feature (e.g., a lower end, a lower shoulder, etc.) of the piston 292 abuts or otherwise contacts a corresponding lower feature 259 (e.g., a lower shoulder) of the housing portion 208 along the chamber 253. In the retracted position of the carriage assembly 290, the pusher rod 294 does not extend into the cavity 280 via the passage 288 and is therefore spaced away from the movable member 287 of the latching mechanism 284 by a predetermined distance, thereby permitting the biasing member 289 to maintain the latching mechanism 284 in the latching position. In the extended position of the carriage assembly 290, the pusher rod 294 extends into the cavity 280 via the passage 288 and pushes or otherwise contacts the movable member 287 of the latching mechanism 284, thereby moving the latching mechanism 284 to the unlatching position. The biasing member 296 may bias the carriage assembly 290 toward the retracted position and, thus, bias the pusher rod 294 to be spaced away from the movable member 287 of the latching mechanism 284. Accordingly, relative movement between the carriage assembly 290 and the housing portion 208 may cause the carriage assembly 290 to move the latching mechanism 284 to the unlatching position, causing the latches 276, 286 to disengage (or unlatch) to thereby permit the arm 278 to pivot from the retracted position to the extended position and, thus, move the holder 272 from the retracted position to the extended position. The biasing member 293 may be stiffer than the biasing member 296, such that the carriage assembly 290 moves to the extended position within and out of the chamber 203 before the carriage 291 moves to the retracted position with respect to the piston 242.

The displacement mechanism 274 may further comprise a lower latch (or trigger) 260 movably connected to the carriage assembly 290. The latch 260 may be pivotably connected to the carriage 291 at a pivot point defined by a pivot pin 255, permitting the latch 260 to pivot to selectively extend out (shown in FIGS. 7 and 8) of the housing portion 208 via a slot opening 283 in the housing portion 208 and to retract (shown in FIGS. 2-6 and 9) into the chamber 297 of the carriage 291 and the housing portion 208. The latch 260 may be operable to engage (e.g., enter, lock with, latch against, etc.) the latching feature 123 located along the main bore 125 of the gas lift mandrel 126 when the kickover tool 200 moves through the main bore 125 of the gas lift mandrel 126. During the downhole operations, after the latch 260 engages the latching feature 123, the latch 260 may cause the carriage assembly 290 to remain static with respect to the gas lift mandrel 126 while the housing 220 and items connected to the housing 220 (including the contact member 263) move upward with the housing 220. During the downhole operations, after the latch 260 engages the latching feature 123, the contact member 263 may be operable to maintain the latch 260 in the extended position when the carriage assembly 290 moves from the retracted position to the extended position, and to move the latch 260 from the extended position to the retracted position when the carriage assembly 290 moves from the extended position to the retracted position.

The latch 260 may be biased by a biasing member 261 (e.g., a leaf spring) to extend out of the housing portion 208. The biasing member 261 may operatively (or communicatively) connected the latch 260 with the contact member 263. For example, one end of the biasing member 261 may be connected to the latch 260 and the opposing end of the biasing member 261 may be free, extending laterally or otherwise away from the latch 260 and be disposed against (in contact with) the contact member 263. The free end of the biasing member 261 may push the contact surface 265 of the contact member 263 to pivotably bias the latch 260 toward the extended position to thereby maintain the latch 260 in the extended position. Thus, during the downhole operations when the housing 220 moves upward within the gas lift mandrel 126 and the contact member 263 moves upward along the window 298, the free end of the biasing member 261 may slide against the contact surface 265 of the contact member 263 while the carriage assembly 290 moves (or slides) with respect to the housing portion 208 from the retracted position to the extended position to bias the latch 260 toward the extended position. The contact surface 265 may extend diagonally (or slantwise) toward the latch 260 (and the biasing member 261) in the downward (downhole) direction. Thus, during the downhole operations when the housing 220 moves upward within the gas lift mandrel 126 and the contact member 263 moves upward along the window 298, the contact surface 265 of the contact member 263 may push the free end of the biasing member 261 progressively closer to the latch 260, thereby flexing the free end of the biasing member 261 progressively closer to the latch 260. After the free end of the biasing member 261 slides off of the contact surface 265 of the contact member 263, the biasing member 261 does not contact the contact member 263 and, thus, cannot bias the latch 260 to the extended position, thereby permitting the latch 260 to move from the extended position to the retracted position. After the free end of the biasing member 261 slides off of the contact surface 265 of the contact member 263, the free end of the biasing member 261 may extend away from the latch 260 past the lower end of the contact member 263 such that the free end of the biasing member 261 is below the opposing contact surface 267. Thereafter, during the downhole operations when the housing 220 moves downward within the gas lift mandrel 126 and the contact member 263 moves downward along the window 298, the free end of the biasing member 261 may slide against the contact surface 267 of the contact member 263 or otherwise contact the contact member 263 while the biasing member 246 moves the carriage assembly 290 with respect to the housing portion 208 from the extended position to the retracted position to therefore move (or pivot) the latch 260 from the extended position to the retracted position. Thereafter, the contact member 263 may maintain the latch 260 in the retracted position when the carriage assembly 290 is maintained in the retracted position.

The kickover tool portion 202 and the kickover tool portion 204 may be operatively connected via an interlock mechanism (or system) 250 operable to prevent the kickover tool portion 204 from installing the new gas lift valve 113 into the side pocket 127 of the gas lift mandrel 126 if the kickover tool portion 202 did not retrieve the used gas lift valve 111 from the side pocket 127. For example, the interlock mechanism 250 may be operable to permit the lower displacement mechanism 274 to move the lower holder 272 from the retracted position to the extended position when the upper holder 222 is in the retracted position and holds the used gas lift valve 111.

The interlock mechanism 250 may comprise a linking member 251 (e.g., a rod, a line, etc.) extending between and operatively connecting the kickover tool portion 202 and the kickover tool portion 204. For example, the linking member 251 may extend between and operatively connect one or more of the saddles 232 located in the upper cavity 230 of the kickover tool portion 202 and the lower displacement mechanism 274 located within the chamber 253 and cavity 280 of the kickover tool portion 204. The linking member 251 may extend between the kickover tool portion 202 and the kickover tool portion 204 via a passage (or bore) 264 extending through a lateral wall 268 of one or more of the housing portions 206, 208. The interlock mechanism 250 may further comprise a biasing member 252 connected to an upper end of the linking member 251 and a latch 254 connected to a lower end of the linking member 251. At least a portion of the latch 254 may be disposed within the chamber 297 of the upper carriage assembly 290 and operable to move between an engaging position (shown in FIGS. 2-6), in which the latch 254 engages (or is positioned to engage) the lower latch 260 to maintain the latch 260 in the retracted position, and a disengaging position (shown in FIGS. 7-9), in which the latch 254 does not engage (or is positioned not to engage) the latch 260 to permit the latch 260 to move to the extended position. While the latch 260 is in the retracted position, the latch 260 cannot engage the latching feature 123 of the gas lift mandrel 126 while the kickover tool 200 moves through the gas lift mandrel 126, thereby preventing sequence of operations of the displacement mechanism 274 causing the lower holder 272 to be moved from the retracted position to the extended position. While in the engaging position, the latch 254 may engage a shoulder 262 of the latch 260 to maintain the latch 260 in the retracted position. The biasing member 252 may bias the latch 254 via the linking member 251 from the engaging position toward the disengaging position. The interlock mechanism 250 may also comprise a latch 256 operable to engage the linking member 251 to maintain (or latch) the linking member 251 in a retracted position, in which the linking member 251 maintains the latch 254 in the engaging position. The latch 256 may be operatively connected to a release member 258 (e.g., a button, a plunger, a lever, etc.) manually operable (e.g., pushable, movable, etc.) to cause the latch 256 to disengage the linking member 251 to therefore permit the biasing member 252 to move the latch 254 via the linking member 251 from the engaging position to the disengaging position. The release member 258 may be disposed in association with (e.g., within) one or more of the saddles 232, such that the release member 258 can be operated (e.g., pushed, pressed, triggered, etc.) by the used gas lift valve 111 when the used gas lift valve 111 is positioned within the saddles 232. Thus, the biasing member 252 may be operable to move the latch 254 to the disengaging position via the linking member 251 when the upper holder 222 is in the retracted position and holds the used gas lift valve 111 to thereby permit the lower displacement mechanism 274 to move the lower holder 272 (and the new gas lift valve 113) from the retracted position to the extended position to permit the new gas lift valve 113 to be installed within the side pocket 127.

The present disclosure is further directed to methods of using or operating the kickover tool 200 perform the downhole operations, including to retrieve a used (or old) gas lift valve 111 from a side pocket 127 of a gas lift mandrel 126 located along and forming a portion of a production tubing 124 within a wellbore 102 and to install a new gas lift valve 113 into the side pocket 127 of the gas lift mandrel 126. FIGS. 3-10 are schematic sectional views of the kickover tool 200 shown in FIG. 2 in various stages of gas lift valve installation and retrieval operations according to one or more aspects of the present disclosure. The kickover tool 200 is shown connected to a cable head 112 as part of a tool string 110 and conveyed within the gas lift mandrel 126 connected along and forming a portion of the production tubing 124. For clarity and ease of understanding of the gas lift valve installation and retrieval operations of the kickover tool 200, each of the FIGS. 3-10 shows the entire kickover tool 200 with respect to a different portion (or segment) of the production tubing 124 and the gas lift mandrel 126. The following description refers to FIGS. 1-10, collectively.

Figure 3:
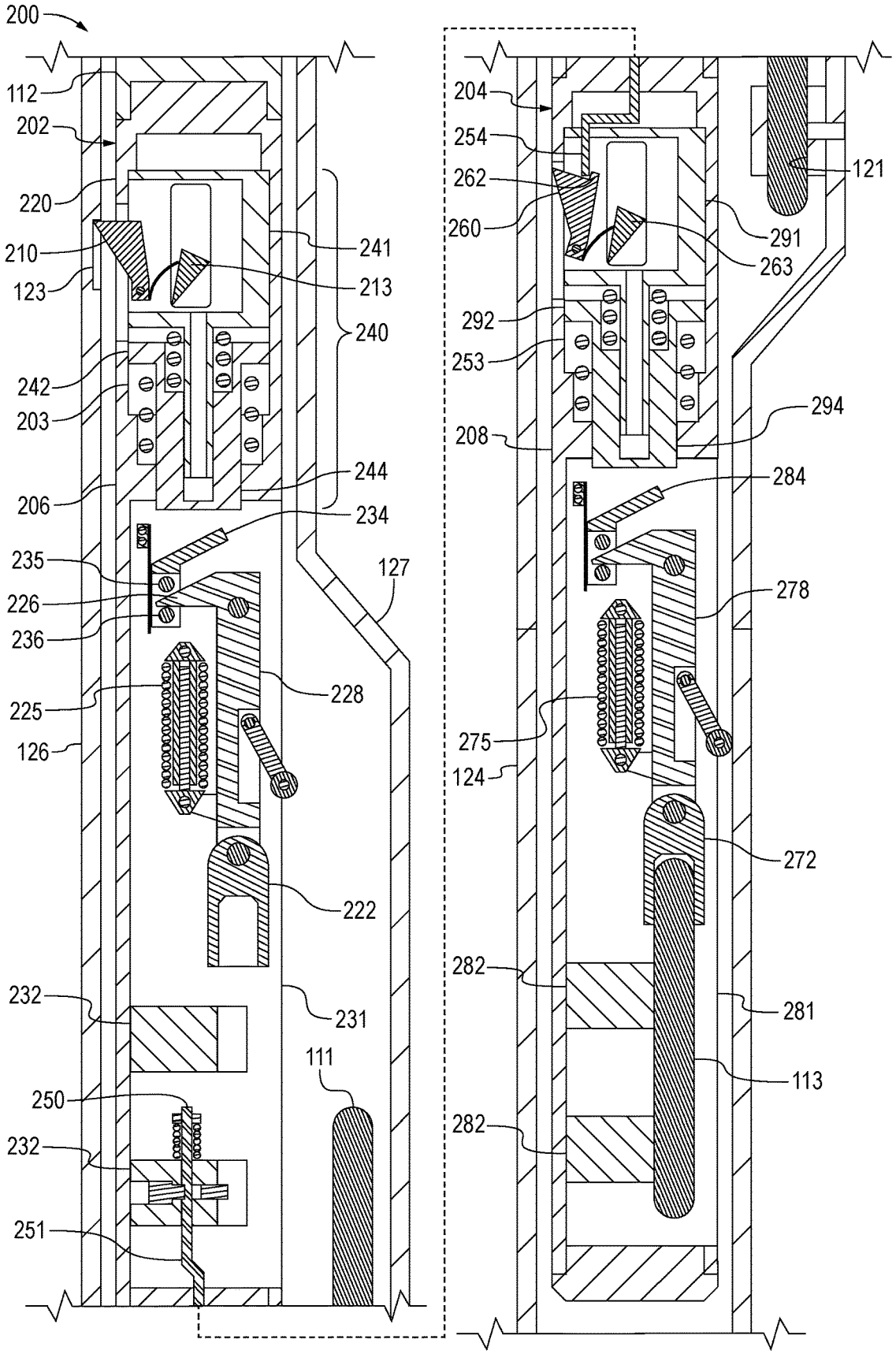
FIGS. 3-10 are side sectional views of the apparatus shown in FIG. 2 in different stages of operation according to one or more aspects of the present disclosure.

An example method may include conveying the tool string 110 comprising the kickover tool 200 downward (downhole) within the production tubing 124 and the gas lift mandrel 126 until the upper kickover tool portion 202 is disposed within the gas lift mandrel 126 from which the used gas lift valve 111 is to be retrieved and within which the new gas lift valve 113 is to be installed. The upper holder 222 of the kickover tool 200 may be empty and in the retracted position and the lower holder 272 may hold the new gas lift valve 113 and be in the retracted position. The upper latch 210 may be in the extended position and the interlock mechanism 250 may maintain the interlock latch 254 in the latching position thereby maintaining the lower latch 260 in the retracted position. The kickover tool 200 may be conveyed downward until the latch 210 is located adjacent to or below the latching feature 123 along the sidewall of the gas lift mandrel 126. The tool string 110 (including the kickover tool 200) may then be pulled upward until the latch 210 engages (e.g., enters, latches against, etc.) the latching feature 123, as shown in FIG. 3, thereby locking in vertical position the latch 210 and the upper carriage assembly 240 connected with the latch 210.

Figure 4:
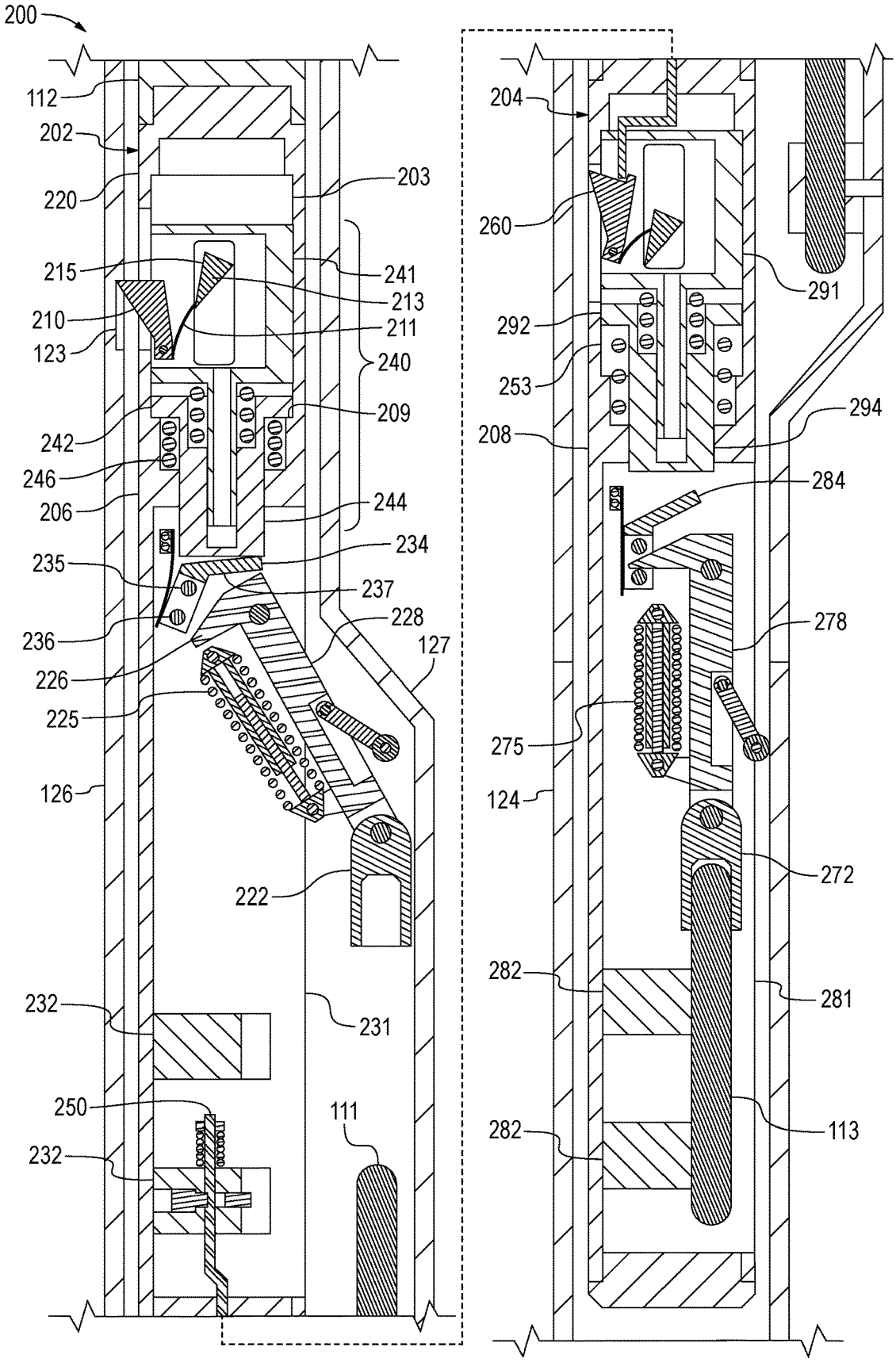

As shown in FIG. 4, the tool string 110 may be pulled further upward along the production tubing 124 (including the gas lift mandrel 126) to thereby cause the housing 220 and portions of the kickover tool 200 connected to the housing 220, such as the upper latching mechanism 234 and the upper arm 228, to move upward while the carriage assembly 240 remains in a static vertical position (or depth) with respect to the housing 220, thereby compressing the biasing member 246 between the housing portion 206 and the carriage assembly 240. The housing 220 may continue to move upward until the lower feature 209 of the housing portion 206 contacts the piston 242 and the pusher rod 244 moves the movable member 237 of the latching mechanism 234 to cause the latches 226, 236 to disengage to thereby permit the upper biasing member 225 to rotate the arm 228 and thereby extend the holder 222 from the retracted position to the extended position. At such position, the empty holder 222 and the used gas lift valve 111 installed within the side pocket 127 are horizontally (or axially) aligned. Furthermore, when the housing 220 and the contact member 213 move upward, the free end of the biasing member 211 slides against the contact surface 215 of the contact member 213 while the carriage assembly 240 moves (or slides) with respect to the housing portion 206 from the retracted position to the extended position to bias the latch 210 toward the extended position and the contact surface 215 of the contact member 213 pushes the free end of the biasing member 211 progressively closer to the latch 210, thereby flexing the free end of the biasing member 211 progressively closer to the latch 210.

Figure 5:
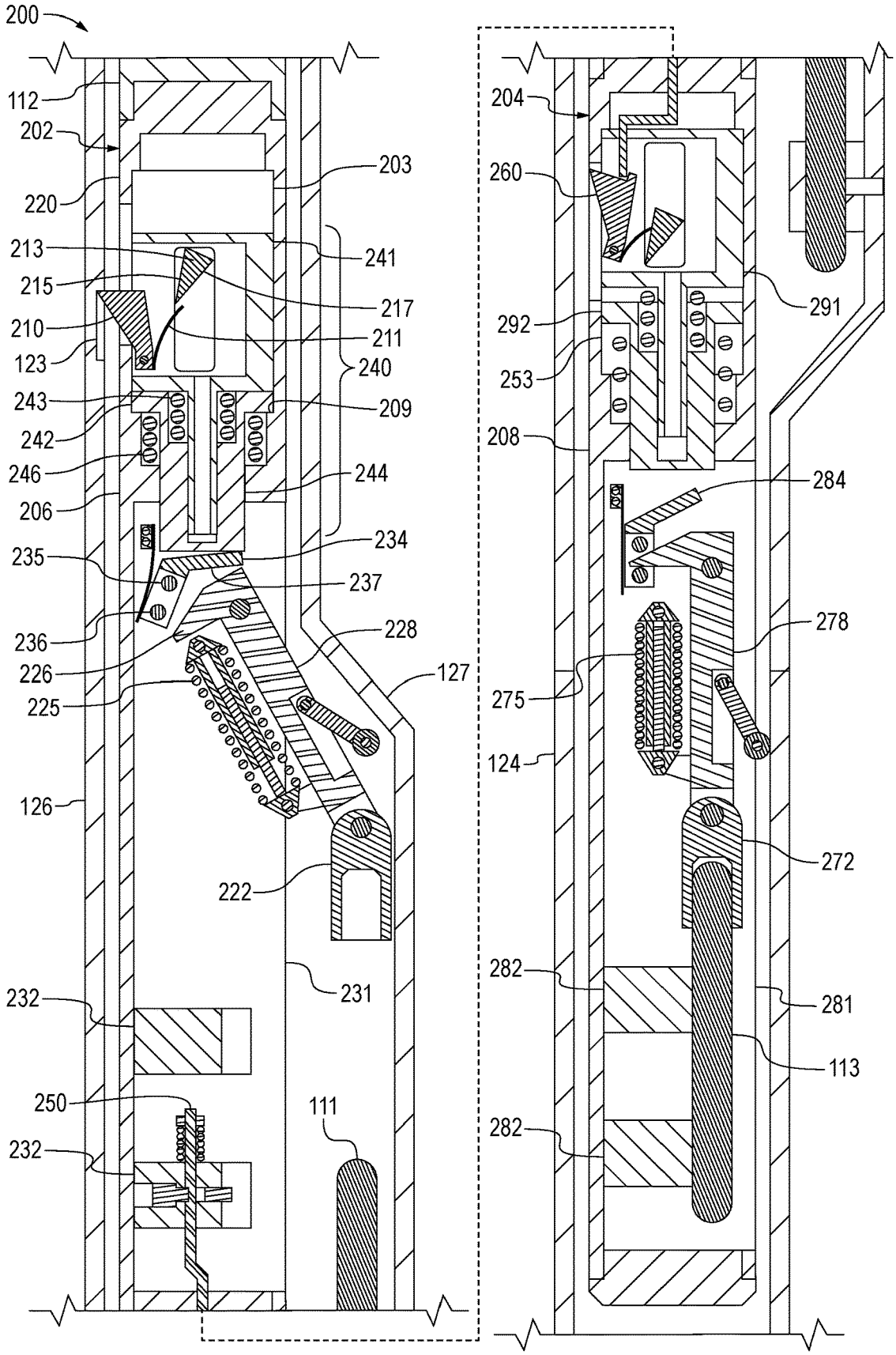

As shown in FIG. 5, the tool string 110 may be pulled still further upward along the production tubing 124 (including the gas lift mandrel 126) after the lower feature 209 of the housing portion 206 contacts the piston 242 to cause the piston 242 to move upward while the carriage 241 remains in a static vertical position with respect to the housing 220, thereby compressing the biasing member 243 between the carriage 241 and the piston 242. The housing 220 may continue to move upward until the piston 242 contacts the carriage 241 and the contact member 213 may continue to move upward along the window 248 until the free end of the biasing member 211 slides off the contact surface 215. After the free end of the biasing member 211 slides off of the contact surface 215 of the contact member 213, the biasing member 211 does not contact the contact member 213 and, thus, cannot bias the latch 210 to the extended position. Furthermore, the free end of the biasing member 211 may extend (flex) away from the latch 210 past the lower end of the contact member 213 such that the free end of the biasing member 211 is below the opposing contact surface 217.

Figure 6:
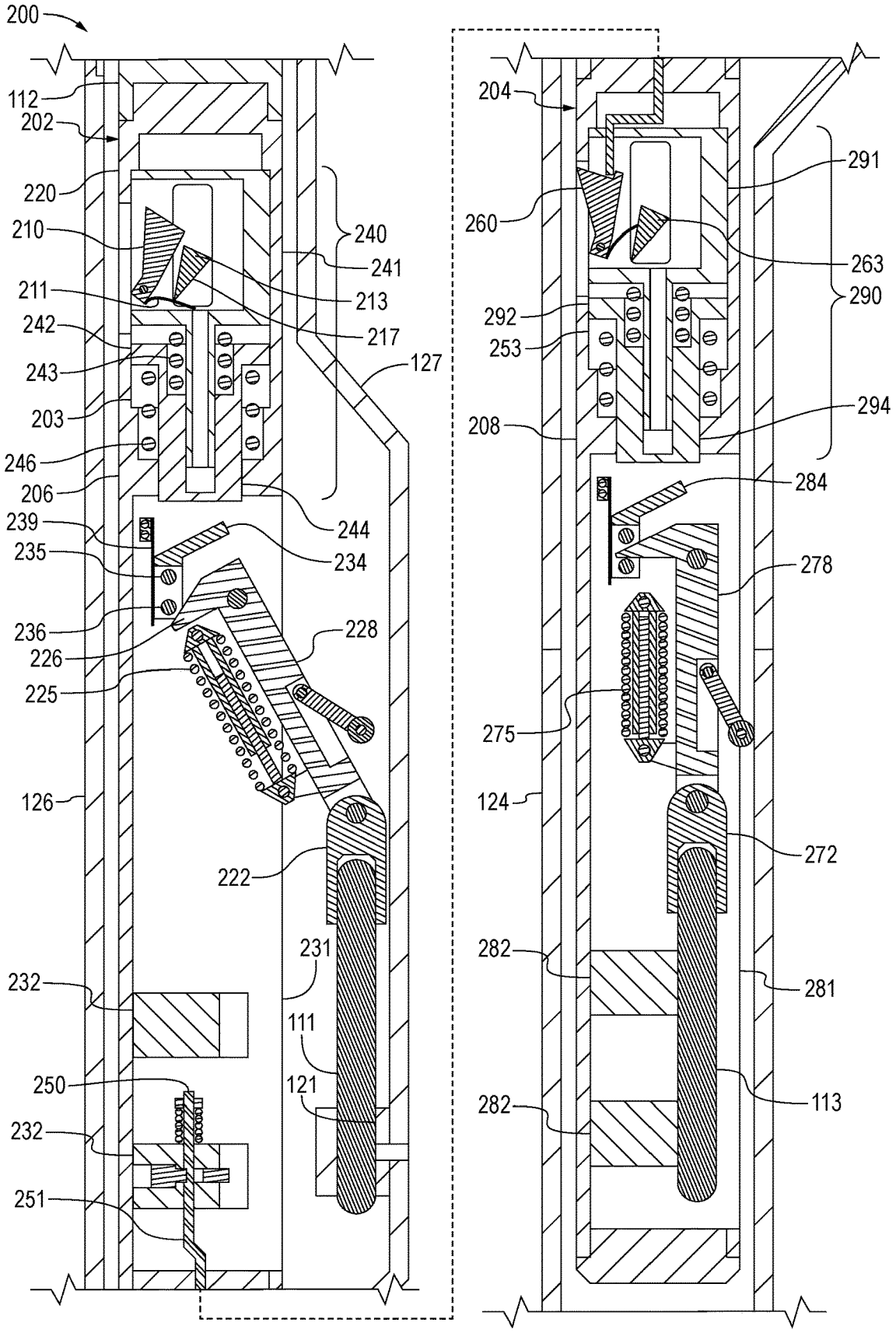

As shown in FIG. 6, the tool string 110 may then be conveyed downward along the production tubing 124 and the gas lift mandrel 126 until the holder 222 engages and connects to the used gas lift valve 111. While the tool string 110 moves downward, the free end of the biasing member 211 slides against the contact surface 217 of the contact member 213 or otherwise contacts (or engages) the contact member 213 to move (or pivot) the latch 210 from the extended position to the retracted position. Thus, as the contact member 213 moves downward with respect to the latch 210, the contact member 213 applies a downward force to the free end or other portion of the biasing member 211, thereby rotating or otherwise moving the latch 210 from the extended position to the retracted position. With the latch 210 in the retracted position and disengaged from the latching feature 123, the biasing member 246 is permitted to move the carriage assembly 240 upward with respect to the housing portion 206 and the biasing member 243 is permitted to move the carriage 241 upward with respect to the piston 242 while the tool string 110 string moves downward. Hence, while the tool string 110 moves downward, the housing 220 moves downward and the carriage assembly 240 moves upward with respect to the housing portion 206 from the extended position to the retracted position such that the pusher rod 244 disengages the latching mechanism 234, thereby permitting the biasing member 239 to move the latching mechanism 234 from the disengaging position to the engaging position.

Figure 7:
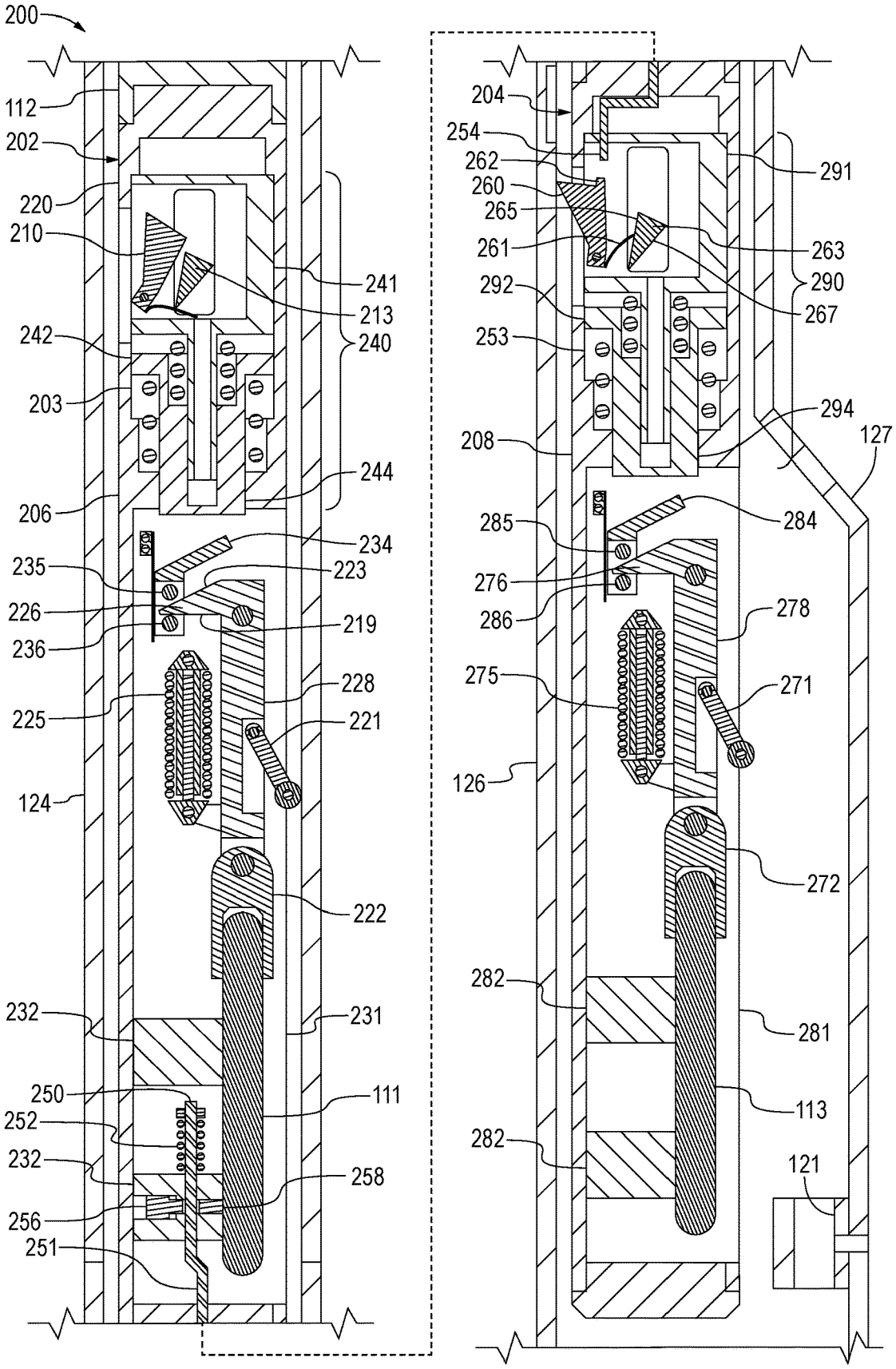

As shown in FIG. 7, the tool string 110 may be conveyed upward within the production tubing 124 and the gas lift mandrel 126 until the kickover tool portion 204 is disposed within the gas lift mandrel 126. While the tool string 110 is conveyed upward, the arm 228 and/or the biasing member 221 may contact the sidewall of the narrower portion of the gas lift mandrel 126 at the upper end of the side pocket 127, forcing or otherwise causing the arm 228 to be rotated from the extended position toward the retracted position. The biasing member 221 may push against the sidewall of the production tubing 124 (including the gas lift mandrel 126) to fully rotate the arm 228 to the retracted position, thereby moving the holder 222 and the used gas lift valve 111 to their retracted positions. As the arm 228 is rotated to the retracted position, the contact surface 223 of the latch 226 may contact the latch 236 of the latching mechanism 234, causing the latching mechanism 234 to pivot about the pivot pin 235 toward the disengaging position until the latches 226, 236 move past each other (or switch positions), at which point the latching mechanism 234 returns to the engaging position in which the latch 236 and the contact surface 219 of the latch 226 engage, thereby maintaining the arm 228 and the holder 222 in their retracted positions.

Also, when the holder 222 reaches the retracted position, the used gas lift valve 111 may contact and operate the interlock mechanism 250, thereby permitting the lower displacement mechanism 274 to move the lower holder 272 from the retracted position to the extended position. For example, the used gas lift valve 111 may contact (or push) the release member 258 to operate (e.g., press, push, move, etc.) the release member 258 to thereby cause the latch 256 to disengage the linking member 251 and, thus, permit the biasing member 252 to move (e.g., pull) the linking member 251. The linking member 251, may move (e.g., pull) the latch 254 from the engaging position to the disengaging position, thereby permitting the biasing member 261 to move the latch 260 from the retracted position to the extended position.

Figure 8:
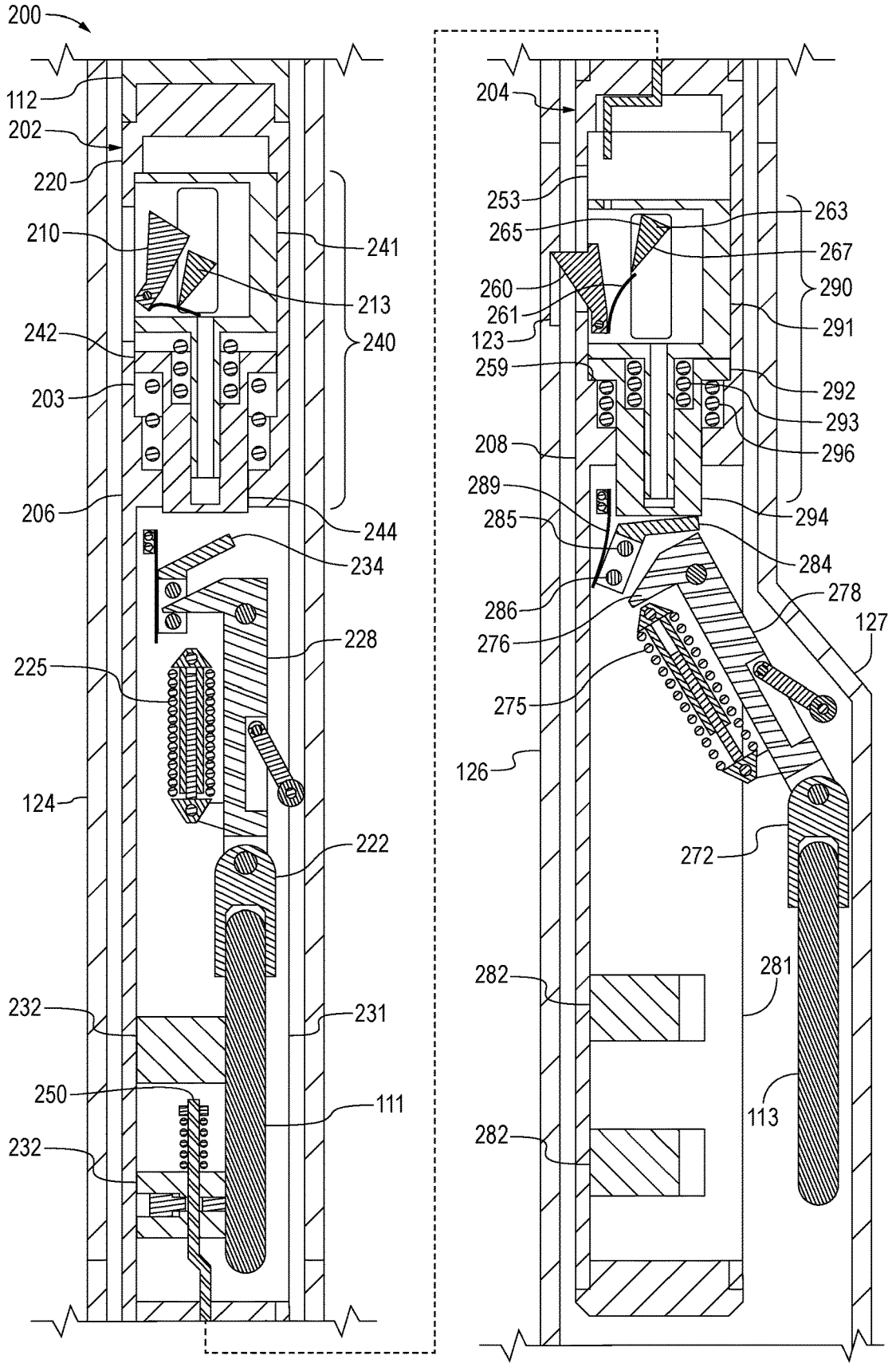

As shown in FIG. 8, the tool string 110 may continue to be conveyed upward along the production tubing 124 (including the gas lift mandrel 126) until the latch 260 engages (e.g., enters, latches against, etc.) the latching feature 123, thereby locking in position the latch 260 and the carriage assembly 290 connected with the latch 260. The tool string 110 may be pulled further upward to cause the housing 220, and portions (e.g., the lower latching mechanism 284, the lower arm 278, etc.) of the kickover tool 200 connected to the housing 220, to move upward while the upper carriage assembly 290 remains in a static vertical position (i.e., at a static depth) with respect to the housing 220, thereby compressing the biasing member 296 between the housing portion 208 and the carriage assembly 290 and compressing the biasing member 293 between the carriage 291 and the piston 292. The housing 220 may continue to move upward until the lower feature 259 of the housing portion 208 contacts the piston 292 and the pusher rod 294 moves the movable member 287 of the latching mechanism 284 to cause the latches 276, 286 to disengage and thereby permit the biasing member 275 to rotate the arm 278 and, thus, extend the holder 272 from the retracted position to the extended position. At such position, the holder 272 and the new gas lift valve 113 are horizontally (or axially) aligned with the receptacle 121 of the side pocket 127.

Furthermore, when the housing 220 and the contact member 263 move upward, the free end of the biasing member 261 slides against the contact surface 265 of the contact member 263 to bias the latch 260 toward the extended position. The contact surface 265 of the contact member 263 pushes the free end of the biasing member 261 progressively closer to the latch 260, thereby flexing the free end of the biasing member 261 progressively closer to the latch 260. The contact member 263 may continue to move upward with the housing 220 until the free end of the biasing member 261 slides off the contact surface 265. After the free end of the biasing member 261 slides off of the contact surface 265 of the contact member 263, the biasing member 261 does not contact the contact member 263 and, thus, cannot bias the latch 260 to the extended position. The free end of the biasing member 261 may then extend (flex) away from the latch 260 past the lower end of the contact member 263 such that the free end of the biasing member 261 is below the opposing contact surface 267.

Figure 9:
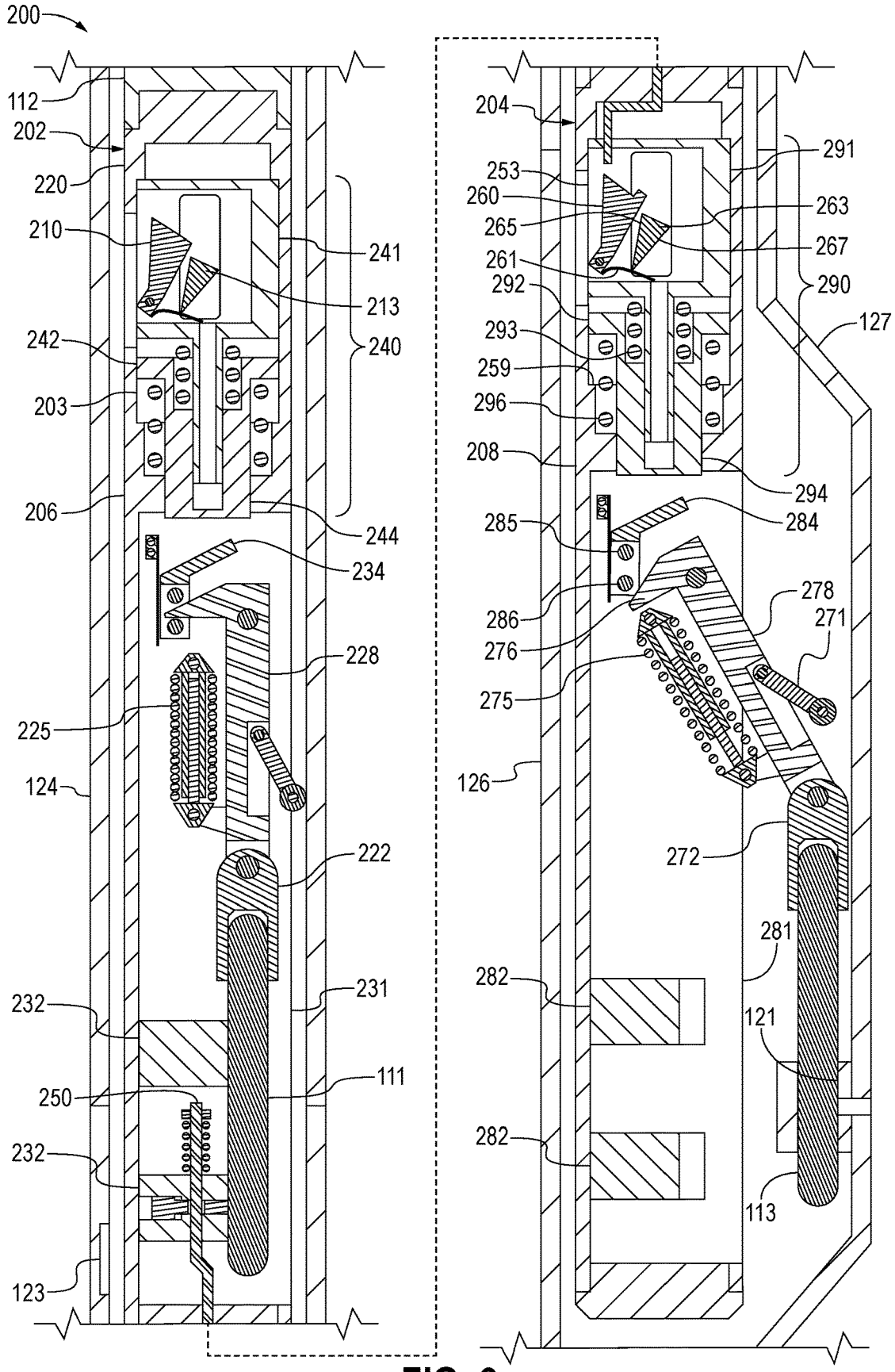

As shown in FIG. 9, the tool string 110 may be conveyed downward along the production tubing 124 (including the gas lift mandrel 126) until the new gas lift valve 113 is installed within the receptacle 121 of the side pocket 127. When the tool string 110 moves downward, the free end of the biasing member 261 slides against the contact surface 267 of the contact member 263 or otherwise contacts (or engages) the contact member 263 to move (or pivot) the latch 260 from the extended position to the retracted position. Thus, as the contact member 263 moves downward with respect to the latch 260, the contact member 263 applies a downward force to the free end or other portion of the biasing member 261, thereby rotating or otherwise moving the latch 260 from the extended position to the retracted position. Thus, when the tool string 110 moves downward, the biasing member 296 is permitted to move the carriage assembly 290 upward with respect to the housing portion 208 and the biasing member 293 is permitted to move the carriage 291 upward with respect to the piston 292. Hence, when the tool string 110 moves downward, the housing 220 moves downward and the carriage assembly 290 moves upward with respect to the housing portion 208 from the extended position to the retracted position. As the carriage assembly 290 moves upward, the pusher rod 294 disengages the latching mechanism 284, thereby permitting the latching mechanism 284 to move from the disengaging position to the engaging position.

Figure 10:
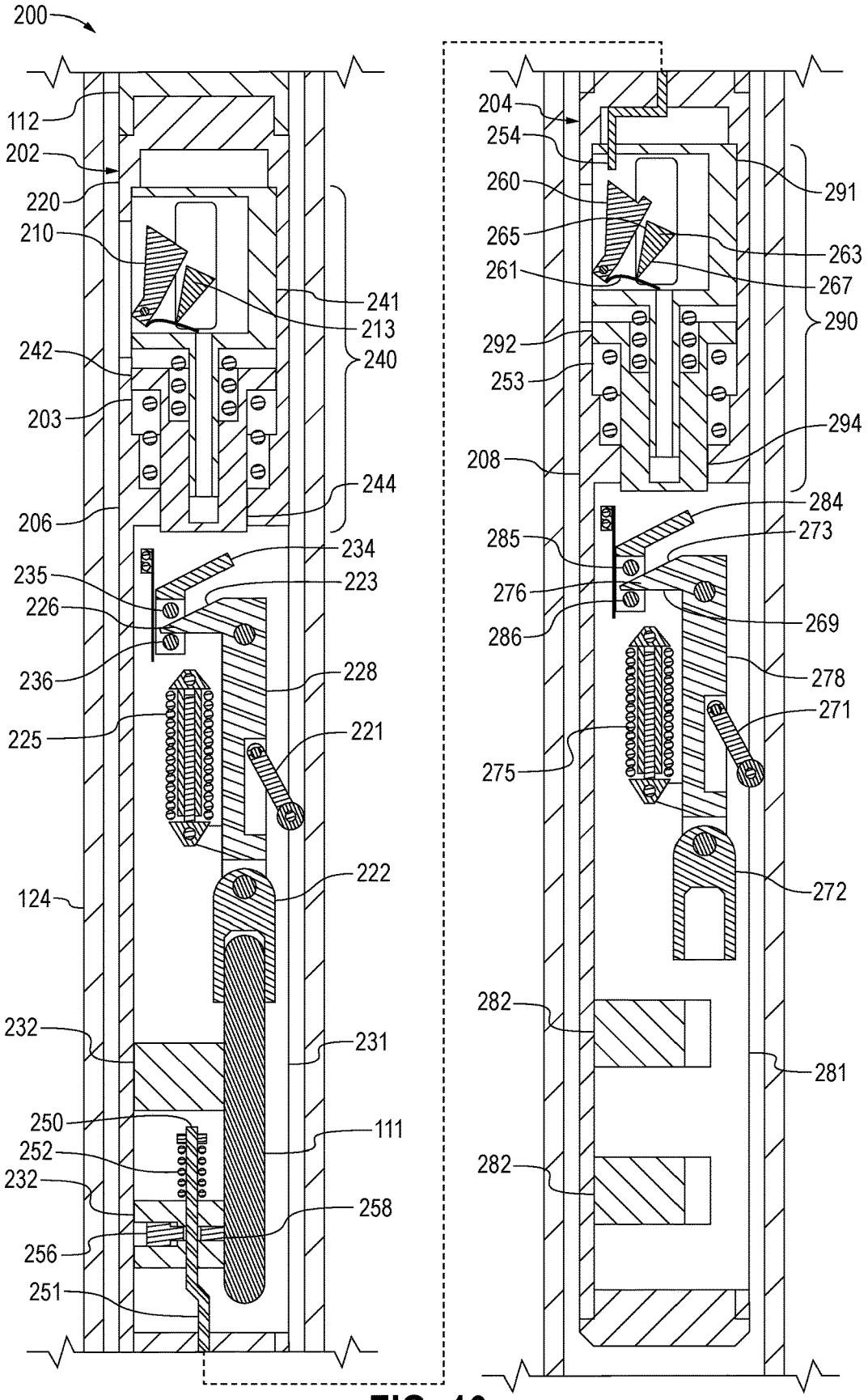

As shown in FIG. 10, the tool string 110 may be pulled upward within the production tubing 124 (including the gas lift mandrel 126) to disconnect the holder 272 from the new gas lift valve 113 installed within the receptacle 121 of the side pocket 127. After the holder 272 disconnects from the new gas lift valve 113, the tool string 110 may be pulled further upward until the kickover tool portion 204 is pulled out of the gas lift mandrel 126, at which time the arm 278 and/or the biasing member 271 may contact the sidewall of the narrower portion of the gas lift mandrel 126 at the upper end of the side pocket 127, forcing or otherwise causing the arm 278 to be rotated from the extended position toward the retracted position. The biasing member 271 may push against the sidewall of the narrower portion of the gas lift mandrel 126 and/or the production tubing 124 to fully rotate the arm 278 to the retracted position, thereby moving the empty holder 272 to the retracted position. As the arm 278 is rotated to the retracted position, the contact surface 273 of the latch 276 may contact the latch 286 of the latching mechanism 284, causing the latching mechanism 284 to pivot about the pivot pin 285 toward the disengaging position until the latches 276, 286 move past each other (or switch positions), at which point the latching mechanism 284 returns to the engaging position in which the latch 286 and the contact surface 269 of the latch 276 engage, thereby maintaining the arm 278 and the holder 272 in their retracted positions.

The tool string 110 may continue to be conveyed upward within the production tubing 124 until the tool string 110 and the used gas lift valve 111 are retrieved to the wellsite surface 104. When the tool string 110 reaches the wellsite surface 104, the used gas lift valve 111 may be disconnected from the holder 222 and another new gas lift valve 113 may be connected to the holder 272. The tool string 110 may then again be conveyed downward to retrieve another used gas lift valve 111 and install the new gas lift valve 113.

Figure 11:
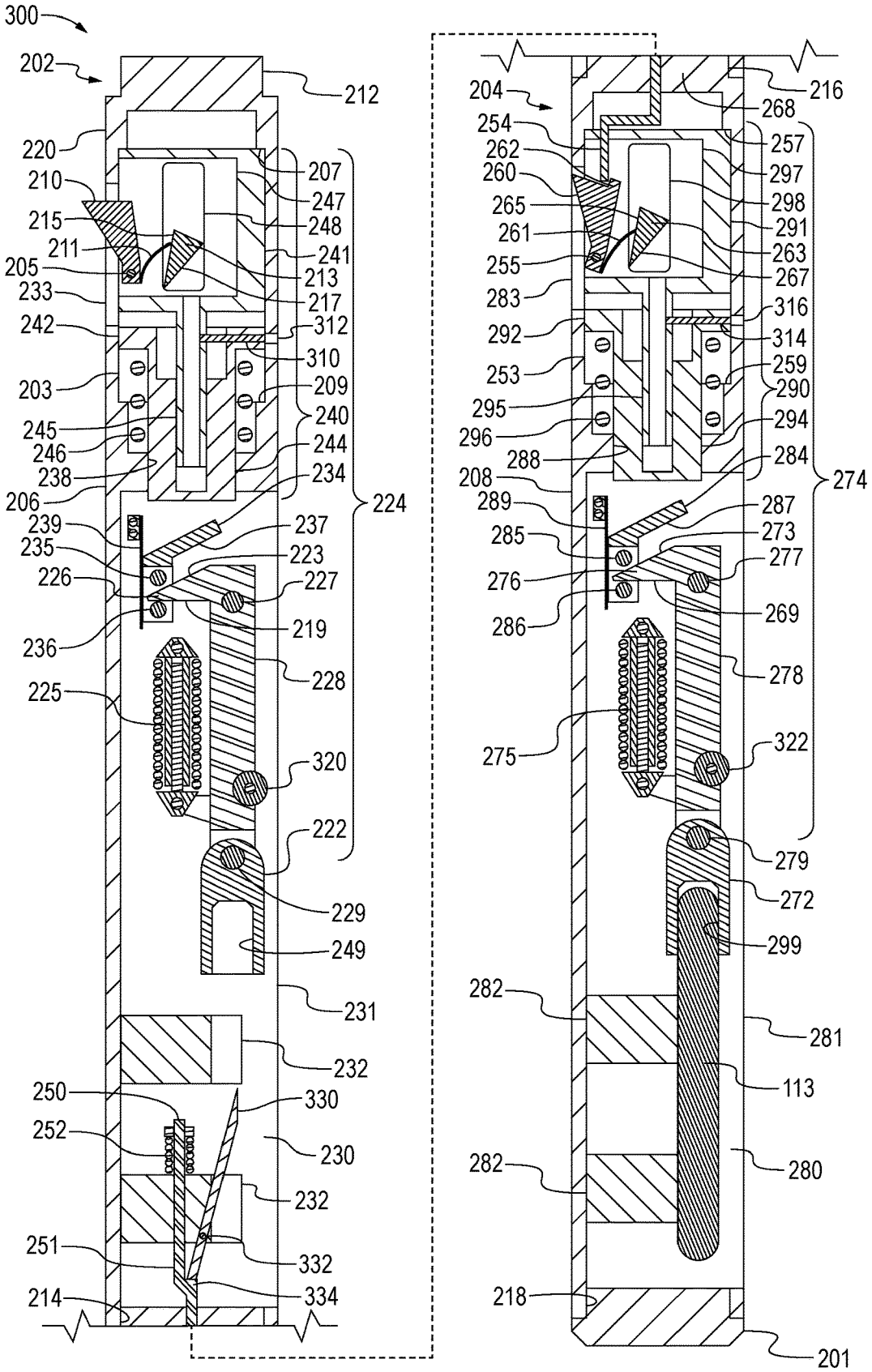
FIG. 11 is a side sectional view of at least a portion of an example implementation of apparatus according to one or more aspects of the present disclosure.

FIG. 11 is a schematic sectional view of at least a portion of an example implementation of a kickover tool 300 operable to perform gas lift valve retrieval and installation operations according to one or more aspects of the present disclosure. For example, the kickover tool 300 may be operable to retrieve a used (or old) gas lift valve 111 from a side pocket 127 of a gas lift mandrel 126 and to install a new gas lift valve 113 within the side pocket 127 of the gas lift mandrel 126. The kickover tool 300 may be an example implementation of the kickover tools 160, 200 described above and shown in FIGS. 1 and 2, respectively. The kickover tool 300 may comprise one or more features and/or modes of operation of the kickover tools 160, 200, including where indicated by the same reference numerals. Accordingly, the following description refers to FIGS. 1, 2, and 11, collectively.

The kickover tool 300 may comprise the carriage assembly 240 having an upper movable member or portion and a lower movable member or portion, each operable to move with respect to the other. For example, the upper movable member may be or comprise the carriage 241 and the lower movable member may be or comprise the piston (or ring) 242. The carriage assembly 240 may further comprise a shear pin 310 fixedly connecting together the carriage 241 and the piston 242 in an extended (or separated) relative position. The shear pin 310 may be inserted between the carriage 241 and the piston 242 via a bore 312 extending through the carriage 241 and the piston 242. The bore 312 may extend through a wall of the housing portion 206, permitting the shear pin 310 to be inserted between the carriage 241 and the piston 242 after the kickover tool 300 is assembled. The carriage 241 and the piston 242 may each contact and slide along the inner surface of the housing portion 206 defining the chamber 203. The piston 242 may comprise or be connected to the pusher rod 244. The carriage 241 may comprise or be connected to the rod 245 telescopically positioned within the bore of the pusher rod 244, permitting relative sliding movement of the carriage 241 and the piston 242 after the shear pin 310 is broken between the extended position (shown in FIGS. 4 and 5), in which the carriage 241 and the piston 242 are separated by a predetermined distance, and a retracted position (shown in FIGS. 2, 3, and 6-9), in which the carriage 241 and the piston 242 abut or are otherwise in contact. The force required to break the shear pin 310 may be larger than the stiffness of the biasing member 246, such that the carriage assembly 240 can move to the extended position within and out of the chamber 203 before the carriage 241 moves to the retracted position with respect to the piston 242 during downhole operations. For example, during gas lift valve installation operations, the tool string 110 may be pulled upward along the production tubing 124 (including the gas lift mandrel 126) after the lower feature 209 of the housing portion 206 contacts the piston 242 to cause the piston 242 to move upward while the carriage 241 remains in a static vertical position with respect to the housing 220 (including the housing portion 206) until the shear pin 310 breaks. Thereafter, the housing 220 and the contact member 213 may continue to move upward until the piston 242 contacts the carriage 241 and the free end of the biasing member 211 slides off of the contact surface 215, in a similar manner as shown in FIG. 5.

The kickover tool 300 may further comprise the carriage assembly 290 having an upper movable member or portion and a lower movable member or portion, each operable to move with respect to the other. For example, the upper movable member may be or comprise the carriage 291 and the lower movable member may be or comprise the piston (or ring) 292. The carriage assembly 290 may further comprise a shear pin 314 fixedly connecting together the carriage 291 and the piston 292 in an extended (or separated) relative position. The shear pin 314 may be inserted between the carriage 291 and the piston 292 via a bore 316 extending through the carriage 291 and the piston 292. The bore 316 may extend through a wall of the housing portion 208, permitting the shear pin 314 to be inserted between the carriage 291 and the piston 292 after the kickover tool 300 is assembled. The carriage 291 and the piston 292 may each contact and slide along an inner surface of the housing portion 208 defining the chamber 253. The piston 292 may comprise or be connected to the pusher rod 294. The carriage 291 may comprise or be connected to the rod 295 telescopically positioned within the bore of the pusher rod 294, permitting relative sliding movement of the carriage 291 and the piston 292 after the shear pin 314 is broken between the extended position (shown in FIG. 8), in which the carriage 291 and the piston 292 are separated by a predetermined distance, and a retracted position (shown in FIGS. 2-7 and 9), in which the carriage 291 and the piston 292 abut or are otherwise in contact. The force required to break the shear pin 314 may be larger than the stiffness of the biasing member 296, such that the carriage assembly 290 can move to the extended position within and out of the chamber 253 before the carriage 291 moves to the retracted position with respect to the piston 292 during downhole operations. For example, during gas lift valve installation operations, the tool string 110 may be pulled upward along the production tubing 124 (including the gas lift mandrel 126) after the lower feature 259 of the housing portion 208 contacts the piston 292 to cause the piston 292 to move upward while the carriage 291 remains in a static vertical position with respect to the housing 220 (including the housing portion 208) until the shear pin 314 breaks. Thereafter, the housing 220 and the contact member 263 may continue to move upward until the piston 292 contacts the carriage 291 and the free end of the biasing member 261 slides off of the contact surface 265, in a similar manner as shown in FIG. 8.

The kickover tool 300 may further comprise friction reducing members 320, 322 connected directly to or otherwise carried by the extendable arms 228, 278 of the displacement mechanisms 224, 274, respectively. The friction reducing members 320, 322 may each be or comprise a rotating member (e.g., a roller, a wheel, a ball bearing, etc.) or other friction reducing member (e.g., a friction reducing plate) configured to contact an inner surface of the production tubing 124 at the opposing end. The friction reducing members 320, 322 may be operable to contact the inner surface of the production tubing 124 to therefore reduce friction between the arms 228, 278 and the production tubing 124 after the arms 228, 278 move to their extended positions and when the kickover tool 300 is being conveyed through the production tubing 124.

The kickover tool 300 may further comprise a latch 330 of the interlock mechanism 250. The latch 330 may be operable to engage the linking member 251 to maintain (or latch) the linking member 251 in the retracted position, in which the linking member 251 maintains the latch 254 in the engaging position. The latch 330 may be or comprise a lever arm pivotably connected at a pivot point 332 to one of the saddles 232 or to the housing portion 206 defining the upper cavity 230. The latch 330 may comprise a latching portion (e.g., a lower end) engaging (i.e., in contact with) a feature 334 (e.g., a shoulder) of the linking member 251 to maintain the linking member 251 and the latch 254 in the engaging position. The latch 330 may further comprise a manually operatable portion (e.g., an upper end) connected to the latching portion and extending within the upper cavity 230 of the housing portion 206. The manually operatable portion of the latch 330 may be manually operated (e.g., pushed, moved, pressed, triggered, etc.) by the used gas lift valve 111 when the used gas lift valve 111 is positioned within the saddles 232 to thereby cause the latch 330 to disengage the linking member 251 and therefore permit the biasing member 252 to move the latch 254 via the linking member 251 from the engaging position to the disengaging position. At least a portion of the latch 330 may be disposed in association with (e.g., within) one or more of the saddles 232, such that the latch 330 can be operated by the used gas lift valve 111 when the used gas lift valve 111 is positioned within the saddles 232. Thus, when the manually operatable portion of the latch 330 is operated by the used gas lift valve 111 and the latching portion of the latch 330 disengages the feature 334 of the linking member 251, the biasing member 252 may be permitted to move the latch 254 to the disengaging position via the linking member 251 to thereby permit the lower displacement mechanism 274 to move the lower holder 272 (and the new gas lift valve 113) from the retracted position to the extended position and thereby permit the new gas lift valve 113 to be installed within the side pocket 127.

In view of the entirety of the present disclosure, including the figures and the claims, a person having ordinary skill in the art will readily recognize that the present disclosure introduces an apparatus comprising a downhole tool, wherein the downhole tool is operable to perform downhole operations to retrieve a used gas lift valve installed within a gas lift mandrel connected along a wellbore tubular string and install a new gas lift valve within the gas lift mandrel, and wherein the downhole tool comprises: a housing; a first holder configured to hold the used gas lift valve; a first displacement mechanism operable to move the first holder between a retracted first holder position in which the first holder is adjacent the housing and an extended first holder position in which the first holder is spaced away from the housing; a second holder configured to hold the new gas lift valve; and a second displacement mechanism operable to move the second holder between a retracted second holder position in which the second holder is adjacent the housing and an extended second holder position in which the second holder is spaced away from the housing.

The housing may comprise a first housing portion and a second housing portion, the first housing portion and the second housing portion may be detachably connected, at least a portion of the first displacement mechanism may be disposed within the first housing portion, and at least a portion of the second displacement mechanism may be disposed within the second housing portion.

The downhole tool may further comprise an interlock mechanism operable to permit the second displacement mechanism to move the second holder from the retracted second holder position to the extended second holder position when the first holder is in the retracted first holder position.

The downhole tool may further comprise an interlock mechanism and, when the second holder holds the new gas lift valve and during the downhole operations, the interlock mechanism may be operable to permit the second displacement mechanism to move the second holder from the retracted second holder position to the extended second holder position when the first holder: is in the retracted first holder position; and holds the used gas lift valve.

The downhole tool may further comprise: a first receptacle defined at least partially by the housing and configured to accommodate the used gas lift valve when the first holder is in the retracted first holder position and holds the used gas lift valve; a second receptacle defined at least partially by the housing and configured to accommodate the new gas lift valve when the second holder is in the retracted second holder position and holds the new gas lift valve; and an interlock mechanism operable to permit the second displacement mechanism to move the second holder from the retracted second holder position to the extended second holder position, wherein the interlock mechanism may comprise a linking member extending between the first receptacle and the second displacement mechanism. In such implementations, among others within the present disclosure, the interlock mechanism may further comprise a biasing member and a latch, wherein the biasing member may be operable to move the latch via the linking member to thereby permit the second displacement mechanism to move the second holder from the retracted second holder position to the extended second holder position when the first holder: is in the retracted first holder position; and holds the used gas lift valve.

The first displacement mechanism may further comprise a first latch operable to engage a latching feature of the gas lift mandrel to thereby cause the first displacement mechanism to move the first holder from the retracted first holder position to the extended first holder position; the second displacement mechanism may further comprise a second latch operable to engage the latching feature of the gas lift mandrel to thereby cause the second displacement mechanism to move the second holder from the retracted second holder position to the extended second holder position; and the downhole tool may further comprise an interlock mechanism operable to permit the second latch to engage the latching feature of the gas lift mandrel to thereby permit the second displacement mechanism to move the second holder from the retracted second holder position to the extended second holder position when the first holder: is in the retracted first holder position; and holds the used gas lift valve.

During the downhole operations, the downhole tool may be operable to: move the first holder from the retracted first holder position to the extended first holder position via the first displacement mechanism; connect the first holder to the used gas lift valve installed within the gas lift mandrel; disconnect the used gas lift valve from the gas lift mandrel; move the first holder holding the new gas lift valve from the retracted first holder position to the extended first holder position via the second displacement mechanism; and install the new gas lift valve within the gas lift mandrel.

The present disclosure also introduces an apparatus comprising a downhole tool, wherein the downhole tool is for installing a gas lift valve within a gas lift mandrel connected along a wellbore tubular string, and wherein the downhole tool comprises: a housing; a holder configured to hold the gas lift valve; and a displacement mechanism operable to move the holder between a retracted holder position in which the holder is adjacent the housing and an extended holder position in which the holder is spaced away from the housing. The displacement mechanism comprises: an arm pivotably connected to the housing, wherein the arm carries the holder; a first latch movably connected to the housing, wherein the first latch and the arm are operable to engage to prevent the arm from moving the holder from the retracted holder position to the extended holder position; a carriage assembly movably disposed within the housing (wherein the carriage assembly: is movable between a retracted carriage assembly position in which the carriage assembly is spaced away from the first latch and an extended carriage assembly position in which the carriage assembly contacts the first latch; and is biased toward the retracted carriage assembly position); and a second latch connected to the carriage assembly and operable to engage a latching feature of the gas lift mandrel.

In the extended carriage assembly position, the carriage assembly may operate the first latch thereby causing the first latch to disengage the arm to permit the arm to move the holder from the retracted holder position to the extended holder position.

In the extended carriage assembly position, the carriage assembly may push the first latch thereby causing the first latch to disengage the arm to permit the arm to move the holder from the retracted holder position to the extended holder position.

The first latch may be pivotably connected to the housing and, in the extended carriage assembly position, the carriage assembly may rotate the first latch thereby causing the first latch to disengage the arm to permit the arm to move the holder from the retracted holder position to the extended holder position.

The first latch may be pivotably connected to the housing; the first latch may comprise a latching portion and a lever portion; and, in the extended carriage assembly position, the carriage assembly may push the lever portion to pivot the first latch thereby causing the latching portion to disengage the arm to permit the arm to move the holder from the retracted holder position to the extended holder position.

The arm may be fixedly connected to a latching member extending laterally with respect to the arm, wherein the first latch and the latching member may be operable to engage to prevent the arm from moving the holder from the retracted holder position to the extended holder position.

When the downhole tool is conveyed uphole along the wellbore tubular string, the second latch may be operable to engage the latching feature of the gas lift mandrel thereby causing the second latch and the carriage assembly to remain stationary with respect to the wellbore tubular string while the housing, the first latch, the arm, and the holder are conveyed uphole along the wellbore tubular string until the carriage assembly reaches the extended carriage assembly position thereby causing the first latch to disengage the arm to permit the arm to move the holder from the retracted holder position to the extended holder position.

The present disclosure also introduces an apparatus comprising a downhole tool, wherein the downhole tool is for installing a gas lift valve within a gas lift mandrel connected along a wellbore tubular string, and wherein the downhole tool comprises: a housing; a holder configured to hold the gas lift valve; and a displacement mechanism operable to move the holder between a retracted holder position in which the holder is adjacent the housing and an extended holder position in which the holder is spaced away from the housing. The displacement mechanism comprises: an arm pivotably connected to the housing, wherein the arm carries the holder; a carriage assembly movably disposed within the housing (wherein the carriage assembly: is movable between a retracted carriage assembly position in which the carriage assembly does not permit the arm to move the holder from the retracted holder position to the extended holder position and an extended carriage assembly position in which the carriage assembly permits the arm to move the holder from the retracted holder position to the extended holder position; and is biased toward the retracted carriage assembly position); a latch movably connected to the carriage assembly, wherein the latch is movable between an extended latch position in which the latch extends out from the housing such that the latch can engage a latching feature of the gas lift mandrel and a retracted latch position in which the latch does not extend out from the housing such that the latch cannot engage the latching feature of the gas lift mandrel; and a contact member connected to the housing, wherein the contact member maintains the latch in the extended latch position and is configured to move the latch from the extended latch position to the retracted latch position.

The latch may be pivotably connected to the carriage assembly, wherein the latch may be operable to pivot between the extended latch position and the retracted latch position.

The contact member may be fixedly connected to the housing such that the contact member is movable with the housing.

The contact member may maintain the latch in the extended latch position when the carriage assembly moves from the retracted carriage assembly position to the extended carriage assembly position, wherein contact member may be configured to move the latch from the extended latch position to the retracted latch position when the carriage assembly moves from the extended carriage assembly position to the retracted carriage assembly position.

The downhole tool may further comprise a biasing member connected to the latch; the contact member may comprise a first contact surface and a second contact surface; the biasing member may be operable to slide against the first contact surface of the contact member when the carriage assembly moves from the retracted carriage assembly position to the extended carriage assembly position to bias the latch toward the extended latch position to thereby maintain the latch in the extended latch position; and the biasing member may be operable to slide against the second contact surface of the contact member when the carriage assembly moves from the extended carriage assembly position to the retracted carriage assembly position to move the latch from the extended latch position to the retracted latch position.

The downhole tool may further comprise a biasing member connected to the latch, wherein the biasing member may be disposed against the contact member to bias the latch toward the extended latch position to thereby maintain the latch in the extended latch position. The biasing member may be or comprise a leaf spring. The biasing member may slide against the contact member when the carriage assembly moves from the retracted carriage assembly position to the extended carriage assembly position to bias the latch toward the extended latch position.

The carriage assembly may comprise a first portion and a second portion; the latch may be movably connected to the first portion; the first portion may be movable between a retracted first portion position in which the first portion contacts the second portion and an extended first portion position in which the first portion is spaced away from the second portion; and the first portion may be biased toward the extended first portion position. In such implementations, among others within the present disclosure, the downhole tool may further comprise a biasing member connected to the latch, wherein the biasing member may be disposed against the contact member to bias the latch toward the extended latch position to thereby maintain the latch in the extended latch position. The biasing member may slide against the contact member when the carriage assembly moves from the retracted carriage assembly position to the extended carriage assembly position to bias the latch toward the extended latch position, wherein the biasing member may slide off of the contact member when the first portion moves from the extended first portion position to the retracted first portion position thereby permitting the latch to move from the extended latch position to the retracted latch position. The contact member may comprise a first contact surface and a second contact surface; the biasing member may slide against the first contact surface of the contact member when the carriage assembly moves from the retracted carriage assembly position to the extended carriage assembly position; and, after the biasing member slides off of the first contact surface of the contact member, the biasing member may slide against the second contact surface of the contact member when the carriage assembly moves from the extended carriage assembly position to the retracted carriage assembly position to move the latch from the extended latch position to the retracted latch position.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus comprising:

a downhole tool operable to perform downhole operations to retrieve a used gas lift valve installed within a gas lift mandrel connected along a wellbore tubular string and install a new gas lift valve within the gas lift mandrel, wherein the downhole tool comprises:

a housing;

a first holder configured to hold the used gas lift valve;

a first displacement mechanism operable to move the first holder between a retracted first holder position in which the first holder is adjacent the housing and an extended first holder position in which the first holder is spaced away from the housing;

a second holder configured to hold the new gas lift valve;

a second displacement mechanism operable to move the second holder between a retracted second holder position in which the second holder is adjacent the housing and an extended second holder position in which the second holder is spaced away from the housing; and an interlock mechanism operable to permit the second displacement mechanism to move the second holder from the retracted second holder position to the extended second holder position when the first holder is in the retracted first holder position and holds the used gas lift valve.

2. The apparatus of claim 1 wherein:

the downhole tool further comprises:

a first downhole tool portion operable to retrieve the used gas lift valve installed within the gas lift mandrel, wherein the first downhole tool portion comprises the first holder and the first displacement mechanism; and a second downhole tool portion operable to install the new gas lift valve within the gas lift mandrel, wherein the second downhole tool portion comprises the second holder and the second displacement mechanism; and the interlock mechanism further comprises a linking member operatively connecting the first downhole tool portion and the second downhole tool portion.

3. The apparatus of claim 1 wherein the interlock mechanism comprises a release member configured to be operated by the used gas lift valve when the first holder is in the retracted first holder position and holds the used gas lift valve to thereby cause the interlock mechanism to permit the second displacement mechanism to move the second holder from the retracted second holder position to the extended second holder position.

4. The apparatus of claim 3 wherein the interlock mechanism further comprises:

a latch engaging the second displacement mechanism to prevent the second displacement mechanism from moving the second holder from the retracted second holder position to the extended second holder position; and a linking member operatively connecting the release member and the latch, wherein when the release member is operated by the used gas lift valve, the linking member is configured to move the latch to thereby permit the second displacement mechanism to move the second holder from the retracted second holder position to the extended second holder position.

5. The apparatus of claim 1 wherein the downhole tool further comprises:

a first receptacle defined at least partially by the housing and configured to accommodate the used gas lift valve when the first holder is in the retracted first holder position and holds the used gas lift valve; and a second receptacle defined at least partially by the housing and configured to accommodate the new gas lift valve when the second holder is in the retracted second holder position and holds the new gas lift valve, wherein the interlock mechanism comprises a linking member extending between the first receptacle and the second displacement mechanism.

6. The apparatus of claim 5 wherein the interlock mechanism further comprises a biasing member and a latch, and wherein, when the first holder is in the retracted first holder position and holds the used gas lift valve, the biasing member is operable to move the latch via the linking member to thereby permit the second displacement mechanism to move the second holder from the retracted second holder position to the extended second holder position.

7. The apparatus of claim 1 wherein:

the first displacement mechanism further comprises a first latch operable to engage a latching feature of the gas lift mandrel to thereby cause the first displacement mechanism to move the first holder from the retracted first holder position to the extended first holder position;

the second displacement mechanism further comprises a second latch operable to engage the latching feature of the gas lift mandrel to thereby cause the second displacement mechanism to move the second holder from the retracted second holder position to the extended second holder position; and when the first holder is in the retracted first holder position and holds the used gas lift valve, the interlock mechanism is operable to permit the second latch to engage the latching feature of the gas lift mandrel to thereby permit the second displacement mechanism to move the second holder from the retracted second holder position to the extended second holder position.

8. The apparatus of claim 7 wherein:

the interlock mechanism comprises a release member, a third latch, and a linking member operatively connecting the release member and the third latch;

the third latch engages the second latch to prevent the second latch from engaging the latching feature of the gas lift mandrel; and when the first holder is in the retracted first holder position and holds the used gas lift valve, the release member is operated to cause the third latch to disengage the second latch to permit the second latch to engage the latching feature of the gas lift mandrel to thereby permit the second displacement mechanism to move the second holder from the retracted second holder position to the extended second holder position.

9. An apparatus comprising:

a downhole tool for installing a gas lift valve within a gas lift mandrel connected along a wellbore tubular string, wherein the downhole tool comprises:

a housing;

a holder configured to hold the gas lift valve; and a displacement mechanism operable to move the holder between a retracted holder position in which the holder is adjacent the housing and an extended holder position in which the holder is spaced away from the housing, wherein the displacement mechanism comprises:

an arm pivotably connected to the housing, wherein the arm carries the holder;

a first latch movably connected to the housing, wherein the first latch and the arm are operable to engage to prevent the arm from moving the holder from the retracted holder position to the extended holder position;

a carriage assembly movably disposed within the housing, wherein the carriage assembly:

is movable between a retracted carriage assembly position in which the carriage assembly is spaced away from the first latch and an extended carriage assembly position in which the carriage assembly contacts the first latch; and is biased toward the retracted carriage assembly position; and a second latch connected to the carriage assembly and operable to engage a latching feature of the gas lift mandrel.

10. The apparatus of claim 9 wherein, in the extended carriage assembly position, the carriage assembly operates the first latch thereby causing the first latch to disengage the arm to permit the arm to move the holder from the retracted holder position to the extended holder position.

11. The apparatus of claim 9 wherein, in the extended carriage assembly position, the carriage assembly pushes the first latch thereby causing the first latch to disengage the arm to permit the arm to move the holder from the retracted holder position to the extended holder position.

12. The apparatus of claim 9 wherein the first latch is pivotably connected to the housing, and wherein, in the extended carriage assembly position, the carriage assembly rotates the first latch thereby causing the first latch to disengage the arm to permit the arm to move the holder from the retracted holder position to the extended holder position.

13. The apparatus of claim 9 wherein:

the first latch is pivotably connected to the housing;

the first latch comprises a latching portion and a lever portion; and in the extended carriage assembly position, the carriage assembly pushes the lever portion to pivot the first latch thereby causing the latching portion to disengage the arm to permit the arm to move the holder from the retracted holder position to the extended holder position.

14. The apparatus of claim 9 wherein the arm is fixedly connected to a latching member extending laterally with respect to the arm, and wherein the first latch and the latching member are operable to engage to prevent the arm from moving the holder from the retracted holder position to the extended holder position.

15. The apparatus of claim 9 wherein, when the downhole tool is conveyed uphole along the wellbore tubular string, the second latch is operable to engage the latching feature of the gas lift mandrel thereby causing the second latch and the carriage assembly to remain stationary with respect to the wellbore tubular string while the housing, the first latch, the arm, and the holder are conveyed uphole along the wellbore tubular string until the carriage assembly reaches the extended carriage assembly position thereby causing the first latch to disengage the arm to permit the arm to move the holder from the retracted holder position to the extended holder position.

* * * * *